US010987820B2

(12) United States Patent
Gegg et al.

(10) Patent No.: US 10,987,820 B2
(45) Date of Patent: Apr. 27, 2021

(54) ADJUSTABLE BODY SHAVER, SYSTEM AND METHOD

(71) Applicants: Peter Alexander Gegg, Belize (BZ); Christopher Joseph Gegg, Belize (BZ)

(72) Inventors: Peter Alexander Gegg, Belize (BZ); Christopher Joseph Gegg, Belize (BZ)

( * ) Notice: Subject to any disclaimer, the term of this patent is extended or adjusted under 35 U.S.C. 154(b) by 59 days.

(21) Appl. No.: 16/077,412

(22) PCT Filed: Feb. 10, 2017

(86) PCT No.: PCT/IB2017/000219
§ 371 (c)(1),
(2) Date: Aug. 10, 2018

(87) PCT Pub. No.: WO2017/137849
PCT Pub. Date: Aug. 17, 2017

(65) Prior Publication Data

US 2019/0047165 A1 Feb. 14, 2019

Related U.S. Application Data

(60) Provisional application No. 62/294,429, filed on Feb. 12, 2016.

(51) Int. Cl.
*B26B 21/42* (2006.01)
*B26B 21/22* (2006.01)
*B26B 21/40* (2006.01)

(52) U.S. Cl.
CPC ..... *B26B 21/42* (2013.01); *B26B 21/222* (2013.01); *B26B 21/4062* (2013.01); *B26B 21/4081* (2013.01)

(58) Field of Classification Search
CPC ..... B26B 21/4081; B26B 21/222; B26B 21/4062; B26B 19/20; B26B 19/3873; B23B 21/42
USPC ..... 30/30, 31, 63, 64, 195, 201, 44, 45; 83/13
See application file for complete search history.

(56) References Cited

U.S. PATENT DOCUMENTS 1,333,315 A * 3/1920 Jacquat ..... B26B 21/42 30/79
2,165,391 A * 7/1939 Lewis ..... B26B 21/08 30/31
2,348,590 A * 5/1944 Ayotte ..... B26B 21/16 30/69
2,612,684 A 10/1952 Mansfield
2,685,733 A * 8/1954 Carter ..... B26B 21/50 30/57

(Continued)

FOREIGN PATENT DOCUMENTS

GB 180932 A * 6/1922 ..... B26B 21/02

*Primary Examiner* — Ghassem Alie
(74) *Attorney, Agent, or Firm* — Buche & Associates, P.C.; John K. Buche; Scott D. Compton

(57) ABSTRACT

The present application is directed to a hand held wet body shaver. The body shaver includes a razor assembly with one or more cutting edges. The razor assembly is adjustable amongst a plurality of fixed settings, each setting dictating the usable length of the one or more cutting edges. The razor assembly is operationally configured maintain a desired alignment amongst its component parts at each fixed setting. The razor assembly is effective for shaving and trimming hair to various desired lengths.

13 Claims, 29 Drawing Sheets

(56) References Cited

U.S. PATENT DOCUMENTS

| | | | | | |
|---|---|---|---|---|---|
| 2,974,412 | A * | 3/1961 | Clark | B26B 19/20 | 30/201 |
| 3,015,158 | A * | 1/1962 | Ayotte | B26B 21/16 | 30/41 |
| 3,289,295 | A | 12/1966 | Tornvall | | |
| 2016/0199988 | A1 * | 7/2016 | Altomare | B26B 19/20 | 83/13 |

* cited by examiner

ADJUSTABLE BODY SHAVER, SYSTEM AND METHOD

CROSS-REFERENCE TO RELATED APPLICATIONS

This application claims the benefit of and priority to U.S. Provisional Patent Application No. 62/294,429 filed Feb. 12, 2016, which is incorporated herein by reference in its entirety.

STATEMENT REGARDING FEDERALLY SPONSORED RESEARCH OR DEVELOPMENT

Not applicable.

FIELD OF THE INVENTION

The application relates generally to an adjustable body hair shaver device of the wet shaving type that contemplates both a disposable cartridge-type blade member that is configured for removable coupling to a non-disposable member of the body shaver and blade members that are integral to the body shaver for discarding of the whole shaver as desired.

BACKGROUND OF THE INVENTION

Hair of a human body is worn and maintained at varying lengths as desired. Due to the natural growth of hair and due to the fairly rapid visual change in the appearance of hair length, it is desirable for an individual to be able to treat hair at one or more target hair shaving areas in a manner effective to maintain a substantially constant hair length over time.

BRIEF SUMMARY OF THE INVENTION

The present application is directed to a shaving device including a handle and a razor assembly located at a front end of the handle. The razor assembly is adjustable amongst a plurality of fixed settings, each setting dictating the length of hair to be cut from one or more shaving areas.

The present application is also directed to a hand held wet shaver comprising a razor assembly including a stationary member having one or more hair cutting edges and an adjustable member in communication with the stationary member. The adjustable member may be fixed at a plurality of distances from the stationary member.

The present application is also directed to a method of shaving hair located at one or more shaving areas to one or more desired lengths, comprising the following steps: (1) providing a hand held shaving device including a razor assembly having one or more cutting edges, the razor assembly being adjustable amongst a plurality of fixed settings, each setting dictating the usable length of the one or more cutting edges; (2) establishing one or more shaving areas and desired length of hair to remain at the one or more shaving areas following shaving; (3) adjusting the razor assembly to a fixed setting according to a first established desired length of hair; and (4) shaving the hair located at the one or more shaving areas.

BRIEF DESCRIPTION OF THE SEVERAL VIEWS OF THE DRAWING

FIG. 78 is a perspective view of an adjustable member of the of the body shaver of FIG. 72 including the actuation member of FIG. 77 in communication there with.

DESCRIPTION OF THE INVENTION

Figure 1:
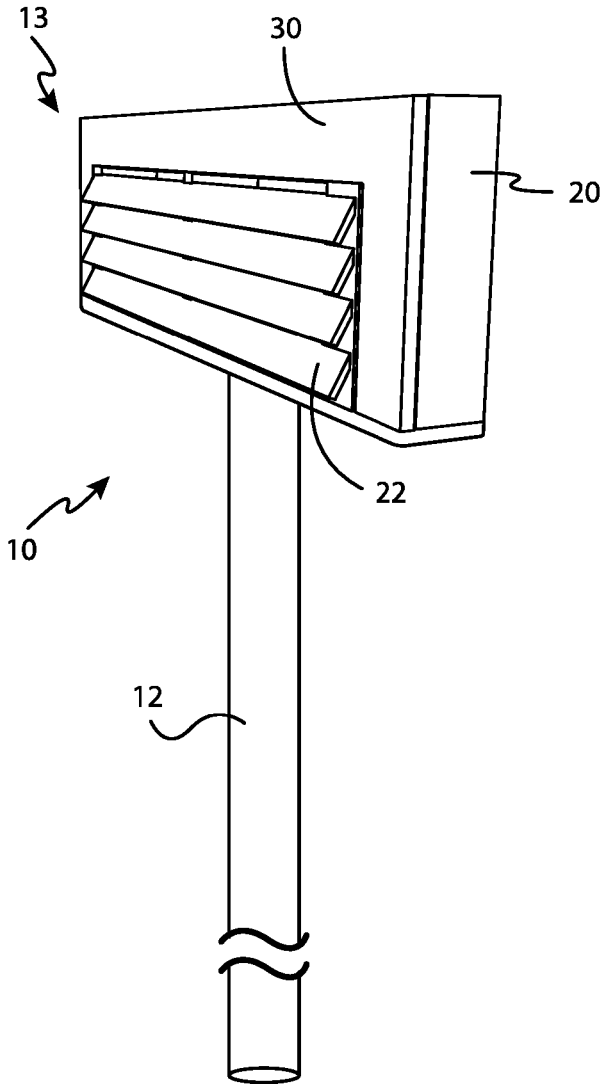
FIG. 1 is a perspective view of an embodiment of a body shaver of this application.

Before describing the invention in detail, it is to be understood that the present device, system and method are not limited to particular embodiments. It is also to be understood that the terminology used herein is for the purpose of describing particular embodiments only, and is not intended to be limiting. As used in this application, the phrase "blade member" may refer to an elongated shaving blade with a cutting edge at the front, a blade end at the rear, a tapered portion leading to the cutting edge and a uniform thickness portion extending from the blade end at the rear to the tapered portion. The term "individual" may refer to humans and/or other mammals for which the present invention is directed for use. Herein, "shaving area" suitably refers to a location on an individual's skin where hair growing out there from is maintained at one or more desired lengths. The terms "treat," "shave" refer to cutting or otherwise removing body hair. The phrases "wet razor" and "wet shaver" are often used interchangeably by persons of ordinary skill in the art and may be used interchangeably herein.

In one aspect, the application provides a device such as an adjustable hand-held body shaver or hair shaver for removing or trimming an unwanted length of hair from one or more target shaving areas. The adjustable hand-held body shaver may be provided as a disposable shaver as the term is commonly understood in the field of wet shavers. The adjustable hand-held body shaver may also be provided with replaceable blade members.

In another aspect, a body shaver is provided including a first stationary member and a second adjustable member operationally configured to adjust the usable length of the cutting edge of one or more blade members for shaving purposes. In another aspect, the application provides a body shaver having a frame adjustable amongst a plurality of operable positions in regard to the body shaver's stationary frame. In another aspect, the application provides a threaded turnable cylindrical screw type member for adjusting the distance between the stationary member and the adjustable member and setting the adjustable member in a fixed position during use, the screw type member having a first end for user manipulation, a middle threaded section for communicating with a stationary member and an opposing end operationally configured to communicate with an adjustable member. In another aspect, the application may include an elongated notched member for adjusting the distance between the stationary member and the adjustable member and setting the adjustable member at a fixed position during use. In another aspect, the application may include a non-turnable elongated member with a slotted or segmented configuration that is in communication with the stationary member in a manner effective to adjust the fixed distance between the adjustable member and the stationary member during use. In another aspect, the application provides a body shaver including an adjustable razor assembly operationally configured to dictate and control the distance between one or more blade members and the target shaving surface locations or areas of a user.

Figure 2:
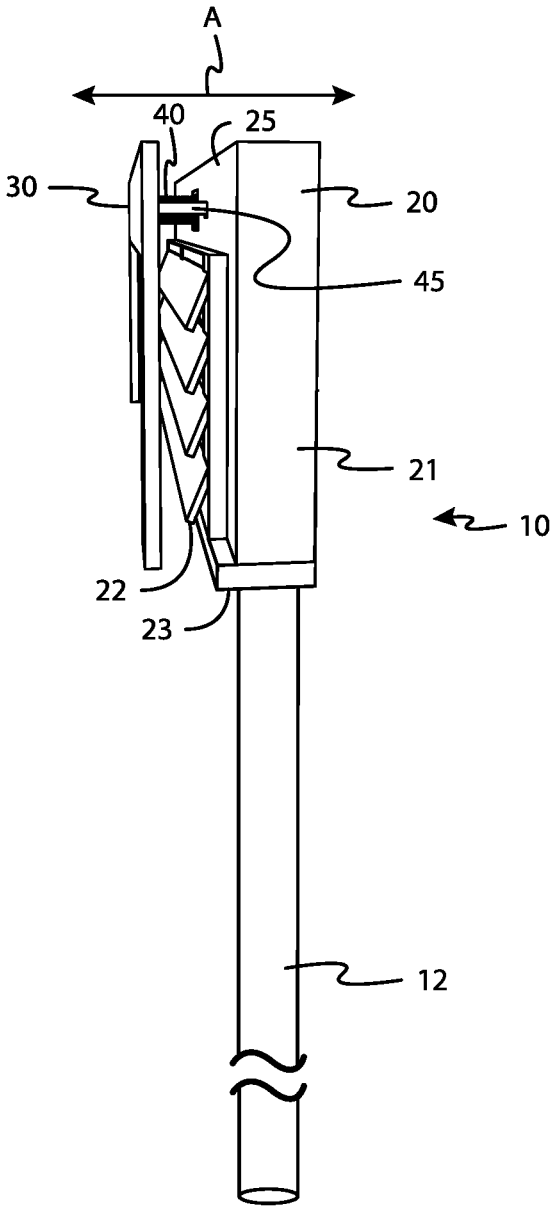
FIG. 2 is another perspective view of the body shaver of FIG. 1.

To better understand the novelty of the device, system and method of use thereof, reference is hereafter made to the accompanying drawings. One exemplary device or "body shaver 10" is depicted in FIGS. 1 and 2. As shown, the body shaver 10 may include a handle 12, as is common to commercially available wet shavers, and a razor assembly 13 (or adjustable razor assembly 13) located at a front end or first end of the handle 12. In this embodiment, the adjustable razor assembly 13 suitably includes a first stationary member 20 (or "cartridge" or "hair cutting cartridge") attached to the handle 12 and a second adjustable member 30 (or "adjustable guard member") operationally configured to dictate the amount or length of hair cutting, trimming or shaving to be accomplished according to the spatial relationship between the first stationary member 20 and second adjustable member 30 during body shaver 10 operation. In other words, the second adjustable member 30 is suitably operationally configured to (1) dictate the distance between a subject's skin and the one or more cutting edges of the stationary member 20 and/or (2) dictate the usable length of one or more cutting edges of the adjustable razor assembly 13.

In this embodiment, the stationary member 20 suitably includes a first surface 23 for receiving a handle 12 in attachment thereto and at least a second surface 25 for engaging at least part of the adjustable member 30 in a first abutment position. In another embodiment, the handle 12 may attach to a different surface of the stationary member 20, e.g., the back or front sides surface, or both the front and back via a V-neck type handle end. As shown in FIG. 2, the adjustable member 30 is adjustably secured to the stationary member 20 via one or more actuation members 40 and one or more guide members 45. The one or more actuation members 40 are operationally configured to direct the adjustable member 30 linearly from a first abutment position with the second surface 25 out to one or more distal positions apart from the stationary member 20 and vice versa (see Directional Arrow A).

Figure 22A:
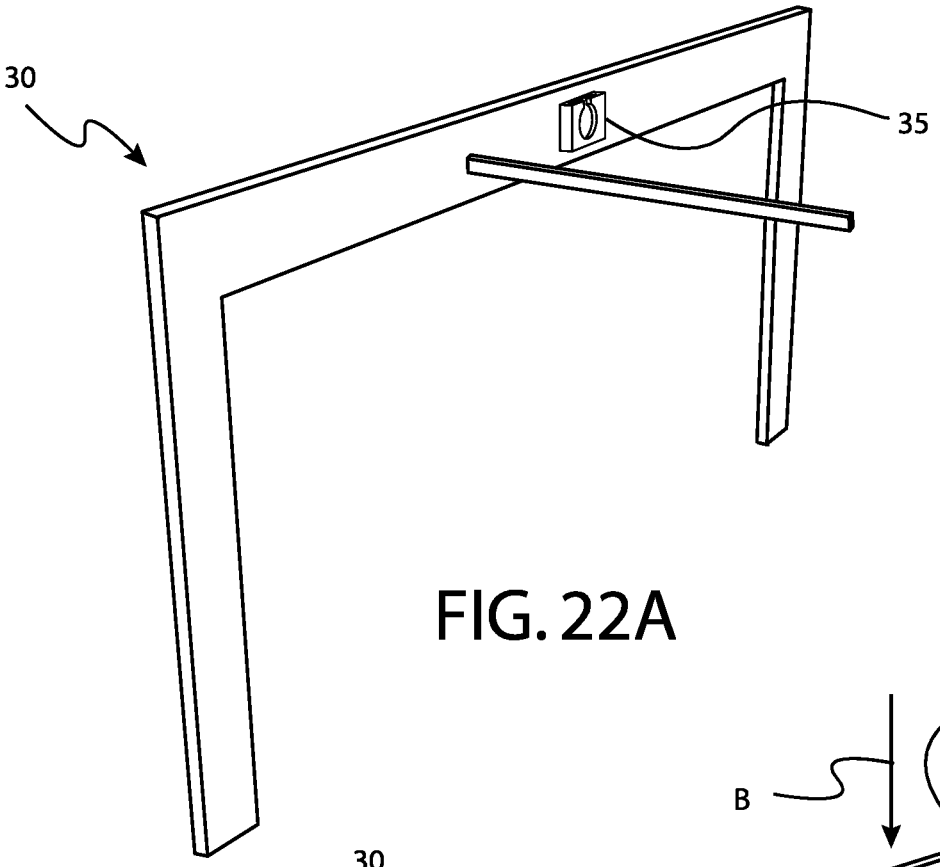
FIG. 22A is a perspective view of another embodiment of an adjustable member of the application.
Figure 22B:
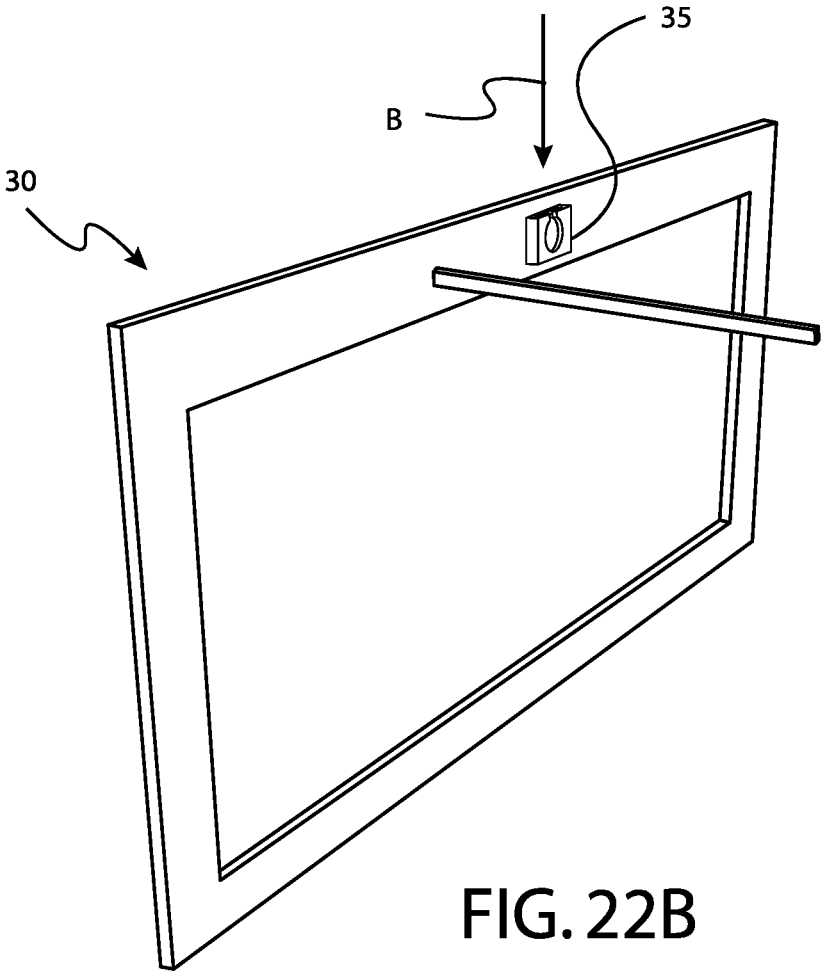
FIG. 22B is a perspective view of another embodiment of an adjustable member of the application.

In one embodiment, the adjustable member 30 may include a rectangular framework type configuration with a perimeter substantially similar in size and shape as the perimeter of the stationary member 20, e.g., see the adjustable member 30 of FIG. 22B. In another embodiment, the shape or configuration of the adjustable member 30 may vary from the shape or configuration of a corresponding stationary member 20. In still another embodiment, the adjustable member 30 may include a three sided framework with a fourth open horizontal side effective to provide for unencumbered razor cutting edge usage whereby target body hair is left undisturbed prior to being contacted by the stationary member 20, e.g., FIG. 22A.

Figure 45:
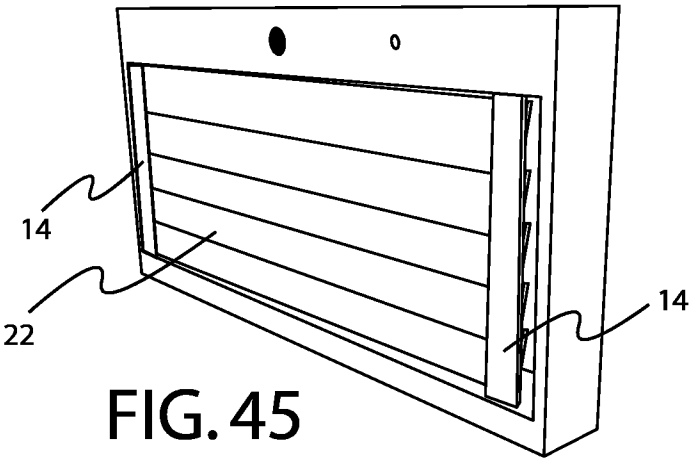
FIG. 45 is an embodiment of a simplified commercially available shaving device illustrating retaining clips securing the blade members to the device.
Figure 48:
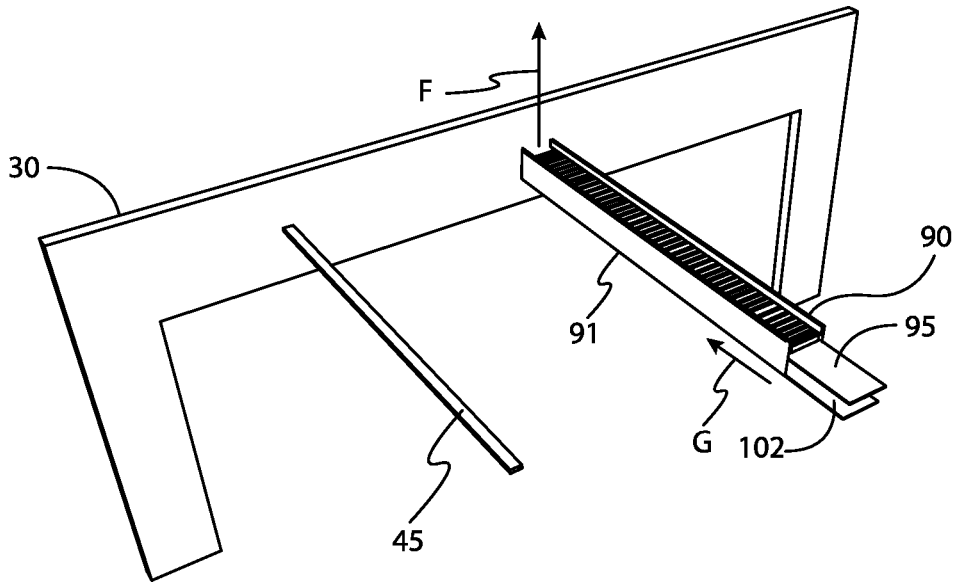
FIG. 48 is a perspective view of another embodiment of an adjustable member and part of an actuation assembly.

As shown in the embodiment of FIGS. 1 and 2, the stationary member 20 may include a corresponding rectangular framework 21 configuration with one or more cutting edges, e.g., a blade assembly defined by one or more blade members 22 disposed horizontally in parallel and attached to the stationary member 20 at or near the distal ends of the blade members 22 as shown. In another embodiment, the blade assembly may include one or more retaining clips 14 (see FIG. 45) or the like at or near the ends of the one or more blade members 22 in a similar manner as commercially available wet shaving devices, the retaining clips 14 being operationally configured to sandwich the one or more blade members 22 against part of the stationary member 20. As understood by the skilled artisan, the stationary member 20 suitably includes one or more apertures or surface configurations operationally configured to receive ends or other parts of the retaining clips 14 in a secure fixed position during operation of the body shaver 10.

Figure 3:
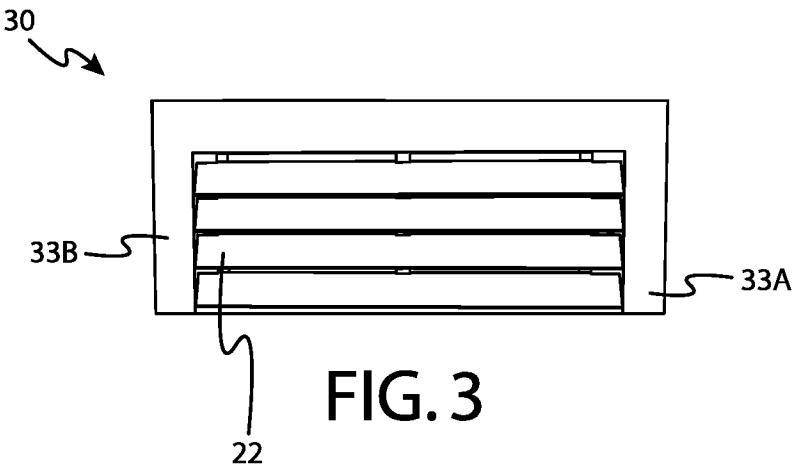
FIG. 3 is a front view of an embodiment of an adjustable razor assembly.
Figure 4:
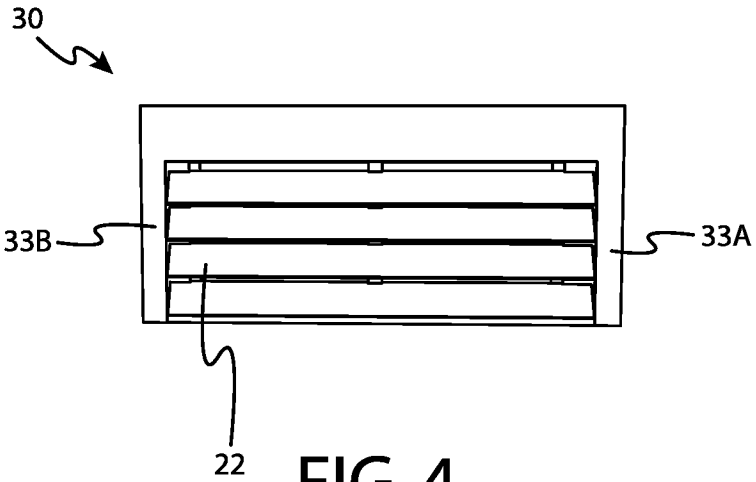
FIG. 4 is a front view of another embodiment of an adjustable razor assembly.
Figure 5:
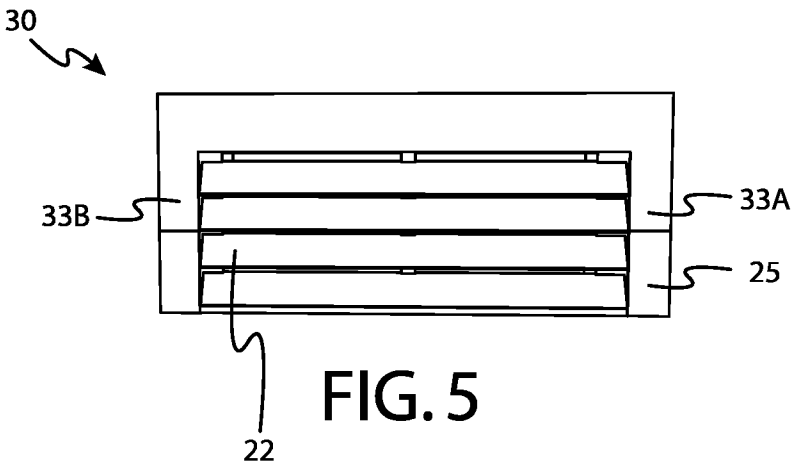
FIG. 5 is a front view of another embodiment of an adjustable razor assembly.
Figure 6:
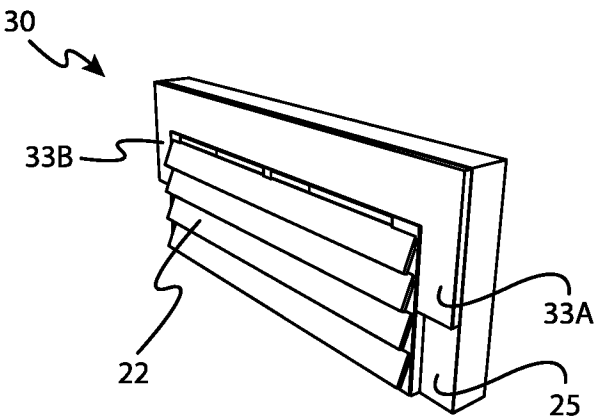
FIG. 6 is a perspective view of the adjustable razor assembly of FIG. 5.

Turning to FIGS. 3 and 4, an adjustable member 30 framework may include opposing sections 33A, 33B with widths as may be desired or required for one or more applications. For example, thinner sections 33A and 33B as depicted in FIG. 4 may be employed in an embodiment where an individual desires to shave near the edge or outline of a styled form of facial hair, e.g., when shaving body hair forming a goatee or sideburns as opposed to shaving a full beard. In still another embodiment as shown in FIGS. 5 and 6, the opposing sections 33A, 33B may include lengths less than the stationary member 20 for one or more shaving applications. As such, a commercial body shaver 10 may be provided with a plurality of adjustable members 30, each serving a different grooming purpose during shaving.

Figure 22C:
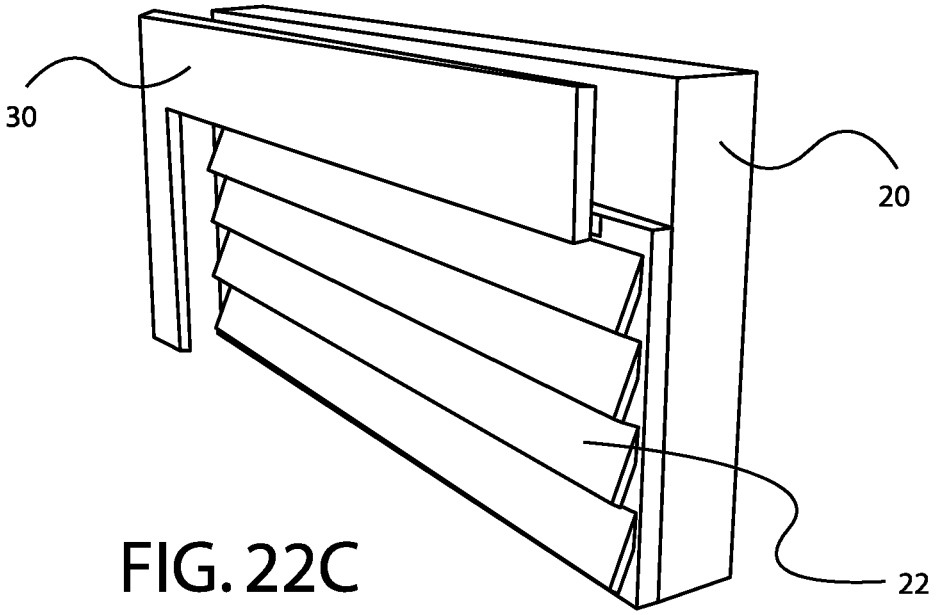
FIG. 22C is a perspective view of another embodiment of an adjustable member of the application set aside an exemplary stationary member.
Figure 22D:
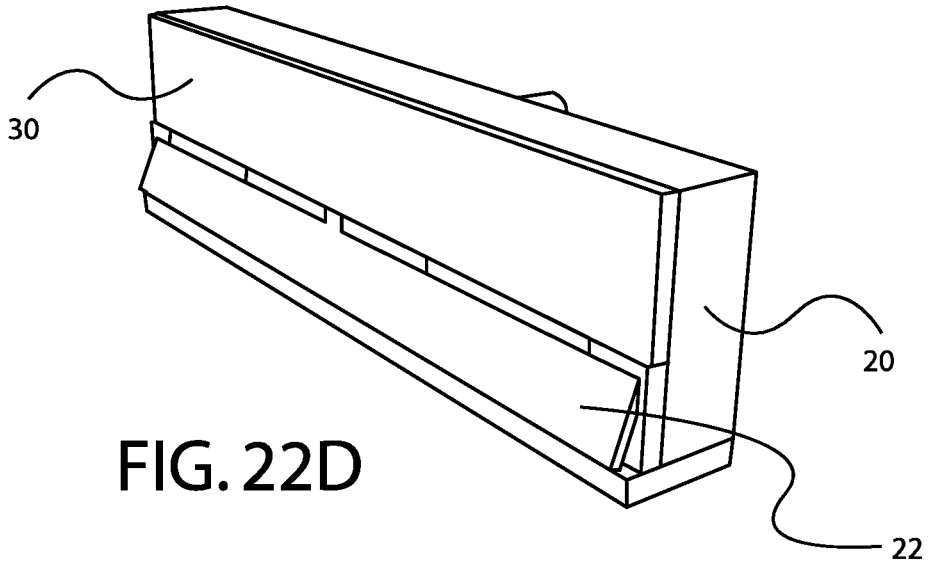
FIG. 22D is a perspective view of another embodiment of an adjustable razor assembly of the application.

As shown in FIG. 22C, another adjustable member 30 may include a two sided framework. A benefit of a two sided framework style adjustable member 30, as compared to a three sided framework, is that a two sided framework may allow for easier shaving of body hair by locating the open side of the adjustable member 30 at the edge of target body hair for edging of body hair when shaving. In still another embodiment, the adjustable member 30 may include a single side as shown in FIG. 22D. A single sided adjustable member 30 may suitably be configured to support a blade assembly alone. In one example, the single sided adjustable member 30 of FIG. 22D may be thicker and/or include a larger surface area than a horizontal section 30A of a two, three and four sided adjustable member 30. In another embodiment, a single sided adjustable member 30 may be provided with a blade assembly having fewer blade members 22 than may be provided via a two, three and four sided adjustable member 30, which may include additional structural support for larger blade assemblies and/or a high number of blade members 22—FIG. 22D illustrates an embodiment including a single blade member 22.

Figure 22E:
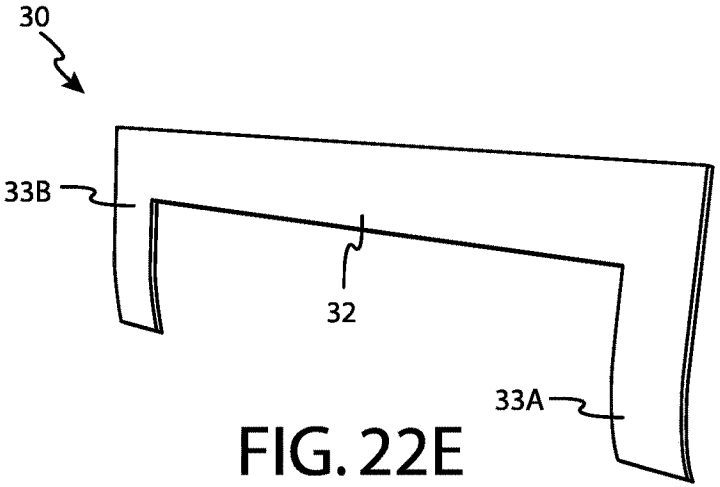
FIG. 22E is a perspective view of another embodiment of an adjustable member of the application.

In still another embodiment, the adjustable member 30 may include curved or partially curved opposing sections 33A, 33B as shown in FIG. 22E. Sections 33A, 33B may terminate with rounded edges or blocked edges as desired. As will be appreciated by the skilled artisan, curved or partially curved sections 33A, 33B may promote a smoother shaving experience, e.g., prevent or reduce dragging or other undesired forces to a person's skin and/or prevent or reduce hair entanglement of the adjustable member 30.

For the purposes of this application, the handle 12 and adjustable razor assembly 13 are not limited to a particular size or shape and may be built to scale. In addition, the adjustable razor assembly 13 is not necessarily limited to any particular number of blade members 22, blade size, blade thickness or blade uniformity. However, size requirements of a particular body shaver 10 may dictate a given number of blade members 22 and/or a given size of blades and/or blade thickness and/or one or more particular types and/or sizes of cutting edges of blade members 22 to be employed.

With reference again to FIGS. 1 and 2, the one or more blade members 22 may be evenly spaced apart, the distance between each blade member 22 being set as desired or as otherwise required for one or more particular applications of the body shaver 10. In one simplified example, the one or more blade members 22 may be spaced apart similar as other commercially available wet razor blades. Also, the one or more blade members 22 may be set at any desired angle relative to the second surface 25 of the stationary member 20, including but not necessarily limited to an angle similar as other commercially available wet razor blades. Also, each of the blade members 22 may be set at a similar angle relative to the second surface 25 or at least one blade member 22 may be set at different angle from the other blade members 22 of the adjustable razor assembly 13. A suitable angle of the one or more blade members 22 may range from about 5.0 degrees to about 50.0 degrees. In addition, one or more blade members 22 may extend out from the second surface 25 a distance greater than one or more other blade members 22.

Suitably, the adjustable razor assembly 13 is operationally configured to provide for cutting and/or trimming and/or shaving of body hair to a particular length according to the distance between the adjustable member 30 and (1) the stationary member 20 and/or (2) the one or more blade members 22. In basic operation, the actuation member 40 may be manipulated in a manner effective to alter the distance between the adjustable member 30 and the stationary member 20. In an embodiment including a turnable actuation member 40 as described below, the maximum distance between the adjustable member 30 and the stationary member 20 may be dictated according to the maximum length of the actuation member 40 or the maximum length of the elongated section 44 of the actuation member 40.

Figure 7:
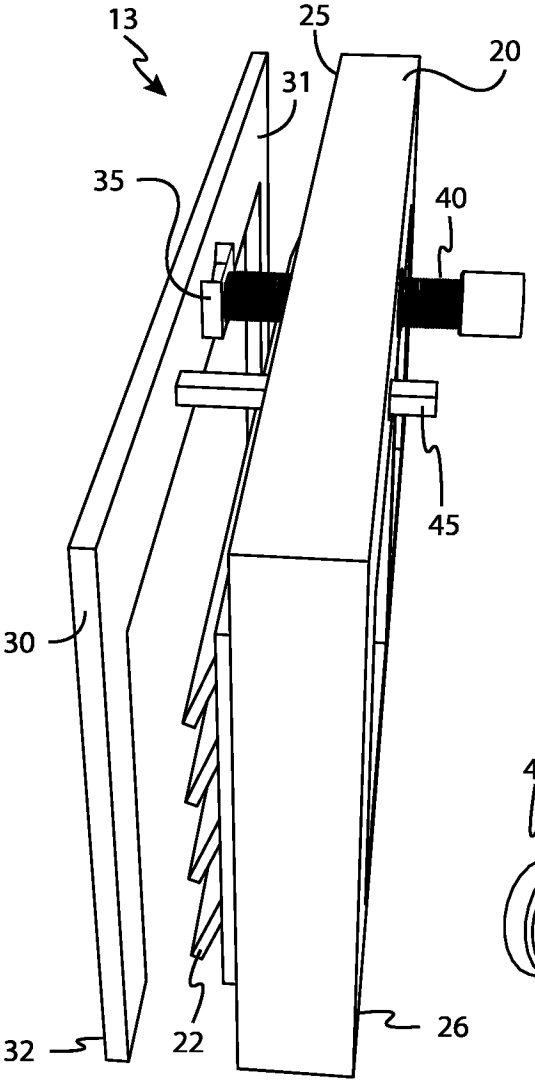
FIG. 7 is a perspective view of an embodiment of an adjustable razor assembly.

Turning to the simplified embodiment of FIG. 7, one or more guide members 45 may be provided to maintain the alignment between the adjustable member 30 and the stationary member 20 as well as provide structural support to the adjustable razor assembly 13 during operation. Suitably, the maximum length of one or more guide members 45 is sufficient to maintain communication between the adjustable member 30 and the stationary member 20 during operation of the body shaver 10. In one suitable embodiment, one or more guide members 45 extend out from an inner surface 31 of an adjustable member 30 in a static position resistant to external forces. In one or more other embodiments, an adjustable razor assembly 13 may be devoid of any guide members 45, whereby an actuation member 40 is operationally configured for alignment and structural support as well as actuation of the adjustable razor assembly 13.

Figure 9:
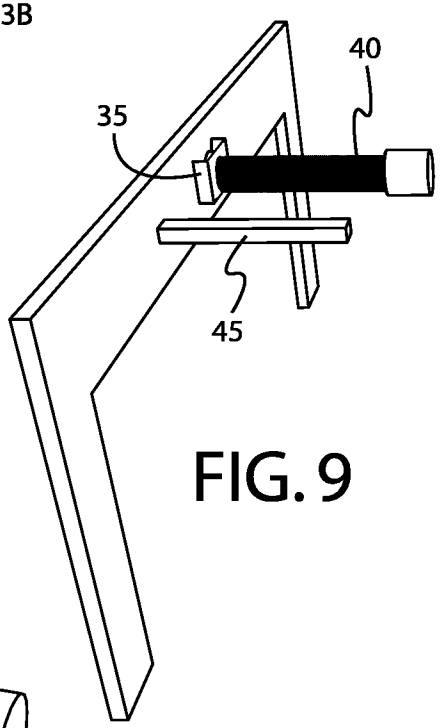
FIG. 9 is a perspective view of the adjustable member of FIG. 8 including a turnable actuation member attached thereto.
Figure 8:
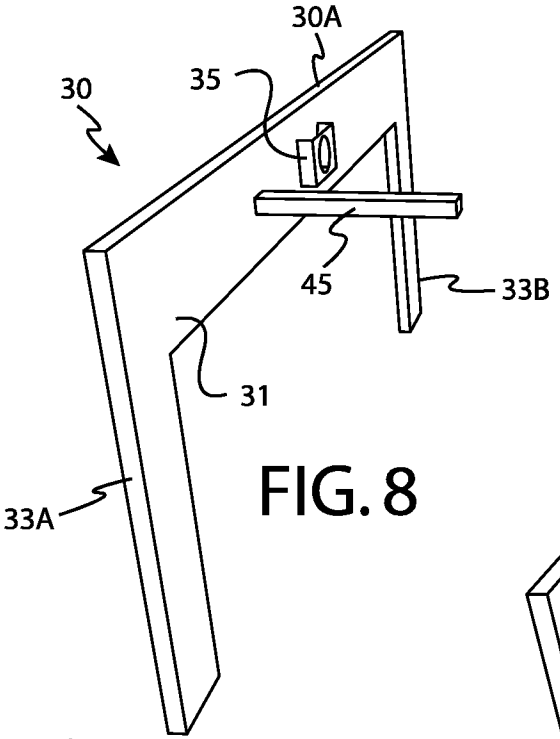
FIG. 8 is a perspective view of an adjustable member of the razor assembly of FIG. 7.

Still referring to FIG. 7, an adjustable razor assembly 13 may include (1) a stationary member 20 defined by a first surface or inner surface 25 and an opposing second surface or outer surface 26, (2) an adjustable member 30 in communication with the stationary member 20, the adjustable member 30 being defined by a first surface or inner surface 31 and a second surface or outer surface 32 and (3) a turnable actuation member 40 in communication with the stationary member 20 and adjustable member 30. As shown in the simplified embodiment of FIG. 8, an adjustable member 30 may include a framework configuration defined by a horizontal section 30A and opposing sections 33A and 33B extending out from opposing ends of the horizontal section 30A in a parallel manner forming right angles with the horizontal section 30A. In one instance, the adjustable member 30 communicates with the stationary member 20 via an elongated guide member 45 extending out from the inner surface 31 to a desired length. The corresponding stationary member 20 suitably includes a first aperture 46 (see FIGS. 11 and 12) that is operationally configured to receive the guide member 45 there through. In this embodiment a guide member 45 is located along the horizontal section 30A of the adjustable member 30. It is also contemplated that one or more guide members 45 may be located along one of either of the vertical sections 33A and 33B. In another embodiment, an adjustable member 30 may include one or more guide members 45 located on the horizontal section 30A and one or both of the vertical sections 33A and 33B. Suitably, the stationary member 20 includes a number of first apertures 46 to accommodate the corresponding guide members 45 present. Guide members 45 and corresponding first apertures 46 are not limited to any shape or configuration. As such, in one particular embodiment, a guide member 45 may be provided with a width greater than its length and include dimensions and/or shapes different than the elongated rectangular box shapes as shown in FIGS. 8 and 9.

Figure 10:
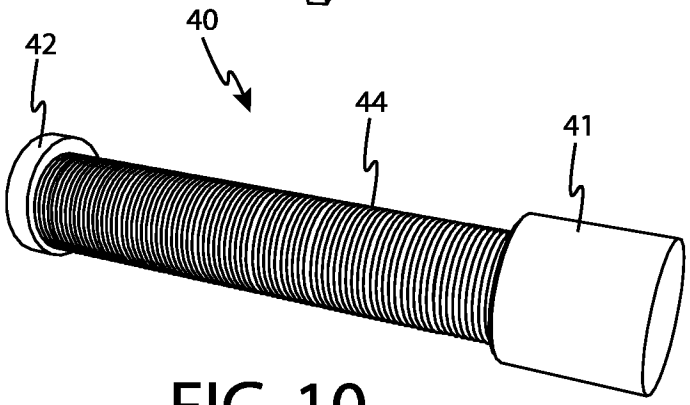
FIG. 10 is a perspective view of the turnable actuation member of FIG. 9.

Without limiting the invention, the spatial relationship between the adjustable member 30 and the stationary member 20 may be determined via one or more actuation members 40, or actuation assemblies, operationally configured to communicate the adjustable member 30 with the stationary member 20. Referring to the embodiment of FIGS. 7-10, actuation may be realized by including an actuation receiving member 35 (or "receiving member 35") located on the inner surface 31 of the adjustable member 30 that is operationally configured to receive at least part of the turnable actuation member 40 in operable or turnable communication. As shown, the turnable actuation member 40 may include a screw type member including a threaded cylindrical shaft member 44 having a first diameter operationally configured to pass through a second aperture 47 (see FIGS. 11 and 12) of the stationary member 20. As understood by the skilled artisan, the second aperture 47 may include a threaded surface for communicating with the threaded shaft member 44. Referring to FIG. 10, the threaded shaft member 44 of this embodiment may include (1) an enlarged first end 41 of a second diameter operationally configured to be manipulated by a user's fingers and/or a tool, e.g., a hand held tool such as a screwdriver, wrench, pliers, and the like, and (2) an enlarged second end 42 operationally configured to communicate with the receiving member 35. Without limiting the scope of the invention, the enlarged second end 42 may include a width or diameter as desired or as otherwise required for suitable operation of the body shaver 10. In this embodiment, the enlarged second end 42 includes a disc type shape.

In one suitable embodiment, an enlarged first end 41, e.g., with a width or diameter greater than the inner diameter of the second aperture 47, may be employed to prevent the actuation member 40 from (1) traveling within the second aperture 47 whereby a user may be unable to retrieve the first end 41 out from the second aperture 47 and (2) passing out through the second aperture 47 apart from the stationary member 20. In addition, the first end 41 may include a surface configuration other than a cylindrical shaped first end 41 as depicted in FIG. 10. For example, a first end 41 may include multiple sides, e.g., a rectangular shape, hexagonal shape, octagonal shape. In another embodiment, a first end 41 may include a T-shape member or a handle lever type member. In addition, a first end 41 may include knurling or another textured type surface effective to promote gripping during manual operation of the actuation member 40. In still another embodiment, a first end 41 may include a width or diameter substantially similar as the threaded shaft member 44 or the first end 41 may include a width or diameter less than the threaded shaft member 44.

Figure 11:
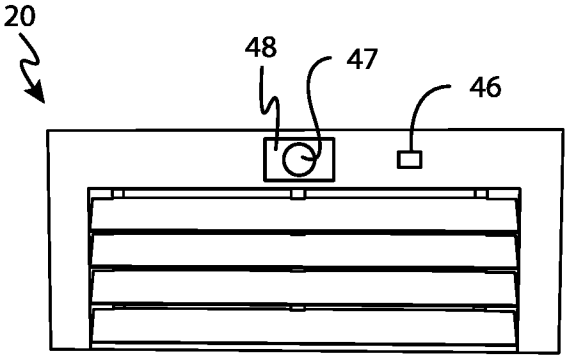
FIG. 11 is a front view of another embodiment of a stationary member of an adjustable razor assembly.
Figure 12:
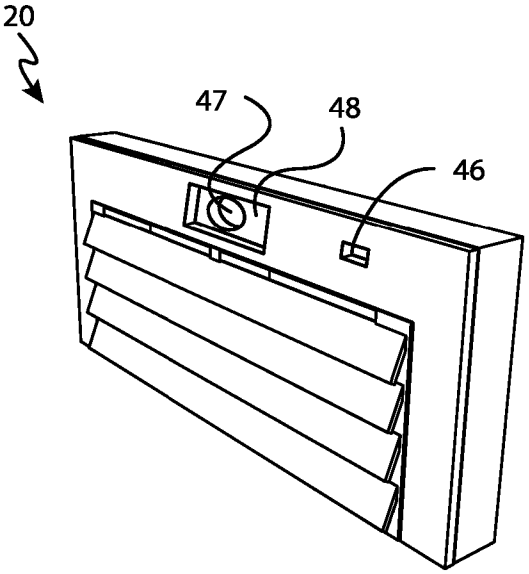
FIG. 12 is a perspective view of the stationary member of FIG. 11.

Still referring to FIGS. 7-10, the receiving member 35 of this embodiment may include a pocket type formation with an aperture for receiving the shaft member 44 there through and an inner surface for receiving and holding the second end 42. Suitably, the diameter of the aperture is less than the diameter of the second end 42 whereby the second end 42 is maintained within the inner surface of the receiving member 35. During body shaver 10 operation, as the actuation member 40 is rotated, the threaded communication between the actuation member 40 and the second aperture 47 is effective to (1) promote travel of the actuation member 40 through the second aperture 47 in either direction (see Directional Arrow A) according to the clockwise or counterclockwise direction the actuation member 40 is turned and (2) hold the actuation member 40 in a fixed position at rest as understood by persons of ordinary skill in the art of threaded connectors. As further understood by the skilled artisan, the configuration of the receiving member 35 and the second end 42 of the actuation member 40 allows the second end 42 to (1) force the adjustable member 30 away from the stationary member 20 when the actuation member 40 is turned in a first direction and (2) pull the adjustable member 30 toward the stationary member 20 when the actuation member 40 is turned in a second opposite direction. As shown in FIGS. 11 and 12, the inner surface 25 of the stationary member 20 of this embodiment suitably includes a recessed area 48 about the perimeter of the second aperture 47, the recessed area 48 being operationally configured to receive the receiving member 35 in a mated position therein in a manner effective for the inner surface 25 of the stationary member 20 to abut the inner surface 31 of the adjustable member 30. Although presented in FIG. 8 in a rectangular configuration, the body of the receiving member 35, and a corresponding recessed area 48, may include other shapes and sizes as desired, e.g., curved perimeters, multi-sided perimeters, irregular shapes, and combinations thereof.

Figure 14B:
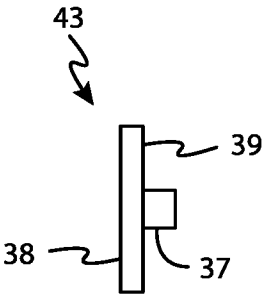
FIG. 14B is a side view of the connector pin as shown in FIG. 14A.
Figure 13:
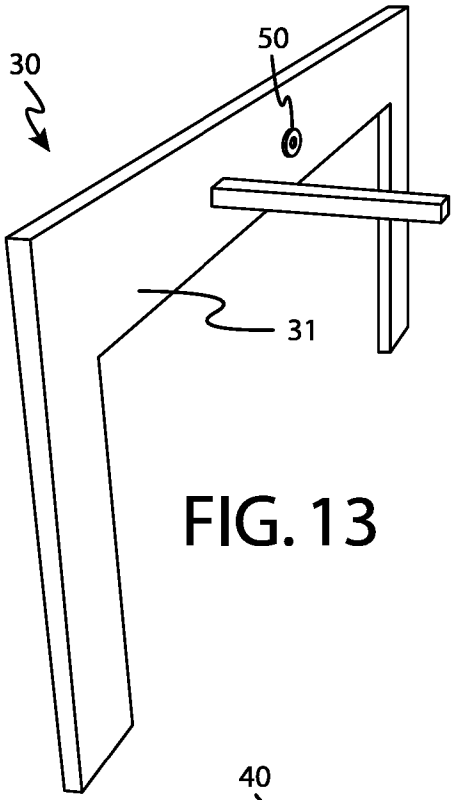
FIG. 13 is a perspective view of another embodiment of an adjustable member of this application.
Figure 15:
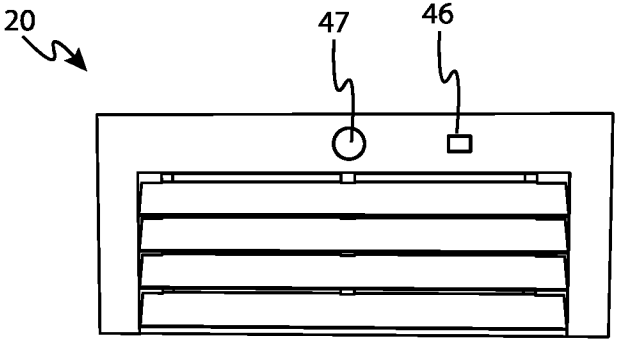
FIG. 15 is a front view of another embodiment of a stationary member of the adjustable razor assembly.
Figure 16:
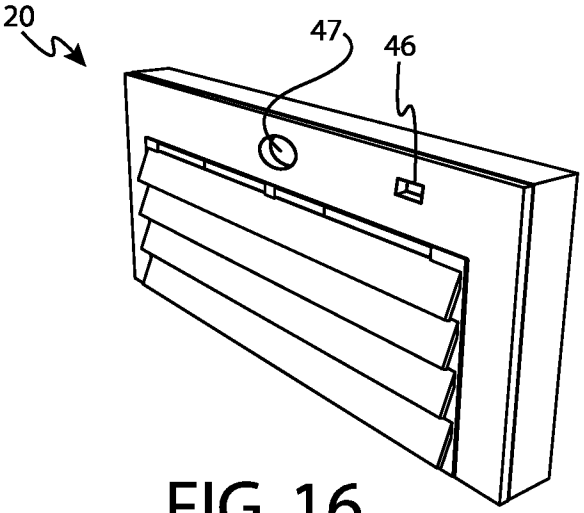
FIG. 16 is a perspective view of the stationary member of FIG. 15.

Turning to FIG. 13, in another embodiment an adjustable member 30 may include a receiving member 35 in the form of a cavity 50 along the inner surface 31 for receiving the actuation member 40 in operable communication. In this embodiment, the second end 42 suitably includes a connector pin 43 with an enlarged head 38 extending out from the surface of the second end 42 (see FIGS. 14A and 14B) operationally configured to mate with and turn within the cavity 50 as the actuation member 40 is turned. As understood by the skilled artisan, the enlarged head 38 may be provided with a neck member 37 as shown. In addition, an enlarged head 38 may be defined by a width or diameter greater than the width or diameter of the opening of the cavity 50 allowing the connector pin 43 to (1) force the adjustable member 30 away from the stationary member 20 when the actuation member 40 is turned in a first direction and (2) pull the adjustable member 30 toward the stationary member 20 when the actuation member 40 is turned in a second opposite direction. In other words, an outer surface of the enlarged head 38 suitably pushes against one or more interior surfaces within the cavity 50 forcing the adjustable member 30 away from the stationary member 20 when the actuation member 40 is turned in a first direction and an inner surface 39 of the enlarged head 38 suitably contacts one or more inner surfaces about the opening of the cavity 50 when the actuation member 40 is turned in a second opposite direction. In this embodiment, the stationary member 20 may not require a recessed area 48, for example, see the surface of the stationary member 20 of FIGS. 15 and 16, which are void of any recessed surfaces 48.

Figure 14A:
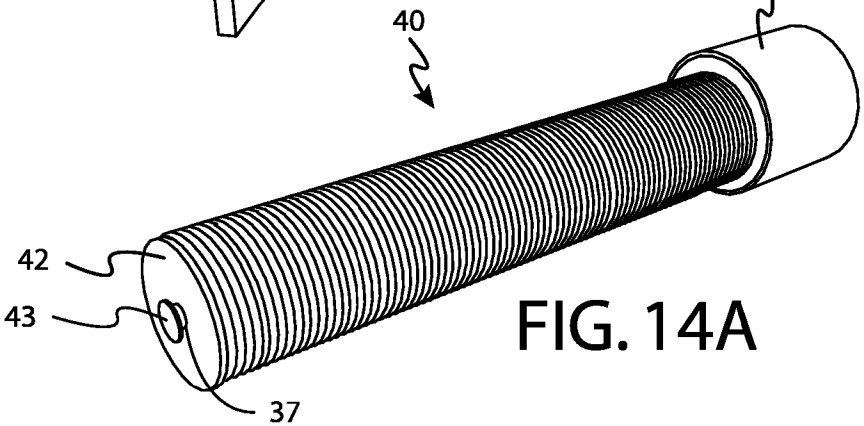
FIG. 14A is a perspective view of another embodiment of a turnable actuation member operationally configured for use with the adjustable member of FIG. 13.

In yet another embodiment, the actuation member 40 of FIG. 14A may be used with an adjustable member 30 having a receiving member 35 similar to the embodiment illustrated in the embodiment of FIG. 8 whereby the receiving member 35 is operationally configured to receive the connector pin 43 in operable communication therein. In another embodiment, an actuation member 40 as shown in FIG. 10 may be communicated with a cavity 50 as shown in FIG. 13 by adjusting the size and shape of the cavity 50.

For purposes of the present application, the above described embodiments of a turnable actuation member 40 suitably turn independent of the stationary member 20 and the adjustable member 30. As shown in FIG. 14A, an enlarged head 38 may include a circular perimeter shape. In another embodiment, the enlarged head 38 may include a segmented circular perimeter shape such as described in U.S. Pat. No. 4,055,236, entitled "Disc brake with an annular metal frame holding part-circular pads," the contents of which is herein incorporated by reference in its entirety. In addition, an enlarged head 38 may be installed within a cavity 50 as desired, e.g., at manufacturing of the body shaver 10 or via assembly post manufacture.

Figure 17:
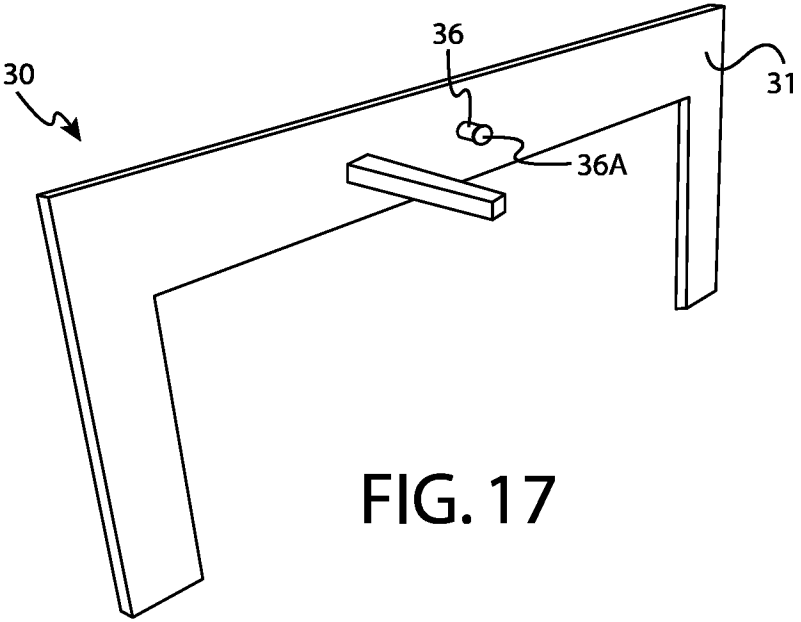
FIG. 17 is a perspective view of another embodiment of an adjustable member of the adjustable razor assembly.
Figure 18:
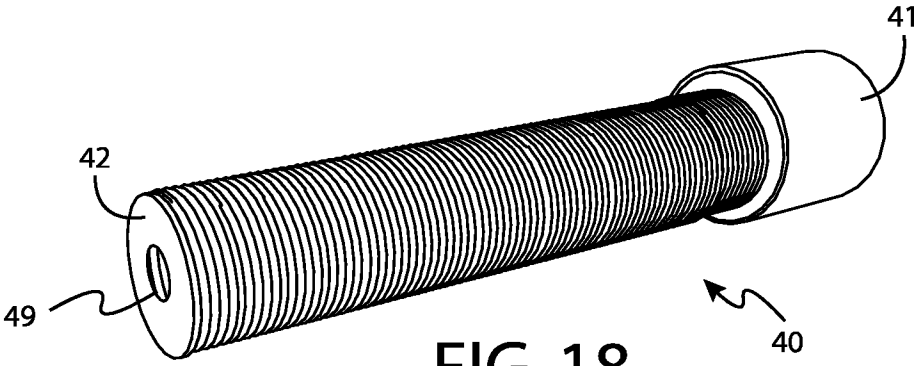
FIG. 18 is a perspective view of another embodiment of a turnable actuation member operationally configured for use with the adjustable member of FIG. 17.

Referring to FIGS. 17 and 18, in another embodiment an actuation receiving member of the adjustable member 30 may be provided as a connector pin 36 located along the inner surface 31, the connector pin 36 being operationally configured to mate with a cavity 49 at the second end 42 of a turnable actuation member 40 via an enlarged distal end 36A of the connector pin 36. In this embodiment, the connector pin 36 is set at a fixed position extending out from the inner surface 31 whereby the actuation member 40 is turnable about the connector pin 36. Suitably, the cavity 49 of the actuation member 40 is operationally configured to maintain at least part of the connector pin 36 therein in a manner effective to (1) force the adjustable member 30 away from the stationary member 20 when the actuation member 40 is turned in a first direction and (2) pull the adjustable member 30 toward the stationary member 20 when the actuation member 40 is turned in a second opposite direction. In this embodiment, the cavity 49 of the actuation member 40 may include a depth as desired—suitably a depth effective to receive an operable amount or length of the connector pin 36 therein, e.g., at least part of the enlarged distal end 36A. It is also contemplated that the cavity 49 may extend within the actuation member 40 to a depth up to just less than the length of the actuation member 40. In another embodiment, the actuation member 40 may be provided as a hollow member with an aperture extending through the actuation member 40 from the first end 41 to the second end 42. As shown, the connector pin 36 and distal end 36A may include cylindrical perimeters. In another embodiment, a connector pin 36 and distal end 36A may include segmented perimeters as described above.

Figure 19:
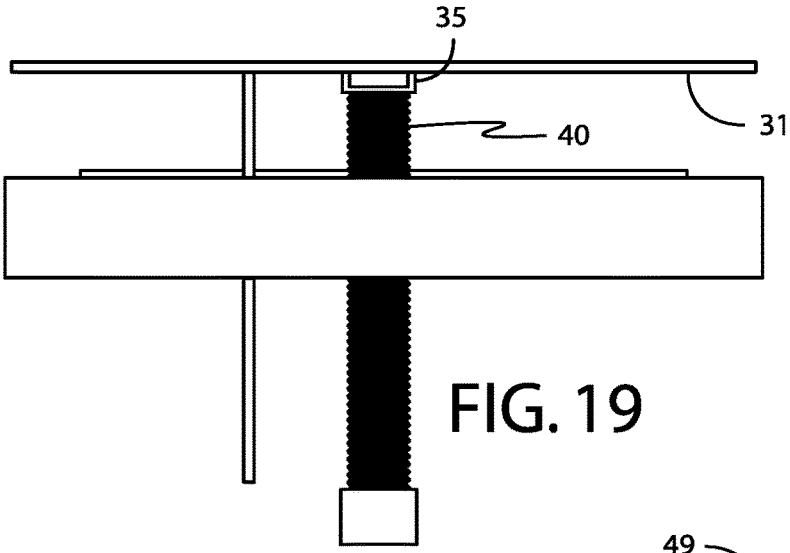
FIG. 19 is a top view of the adjustable razor assembly of FIG. 7.
Figure 20:
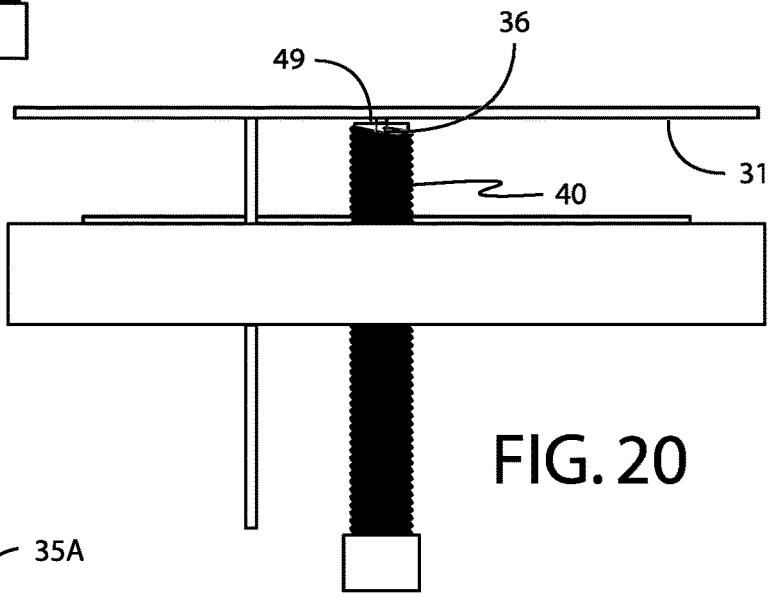
FIG. 20 is a top view of another embodiment of an adjustable razor assembly.
Figure 21:
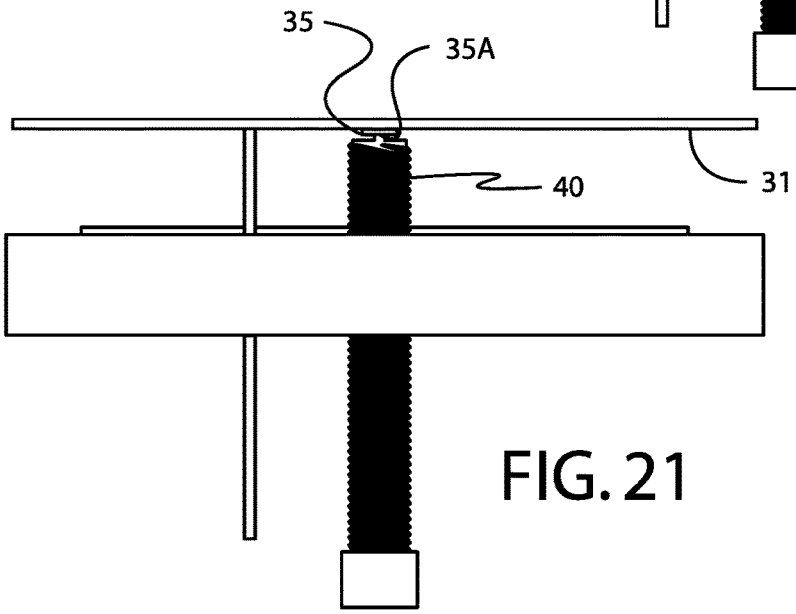
FIG. 21 is a top view of another embodiment of an adjustable razor assembly.
Figure 24:
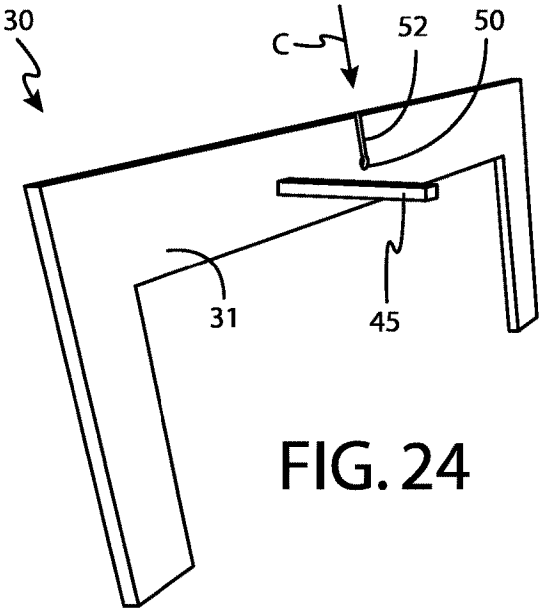
FIG. 24 is a perspective view of another embodiment of an adjustable member of the application.
Figure 25:
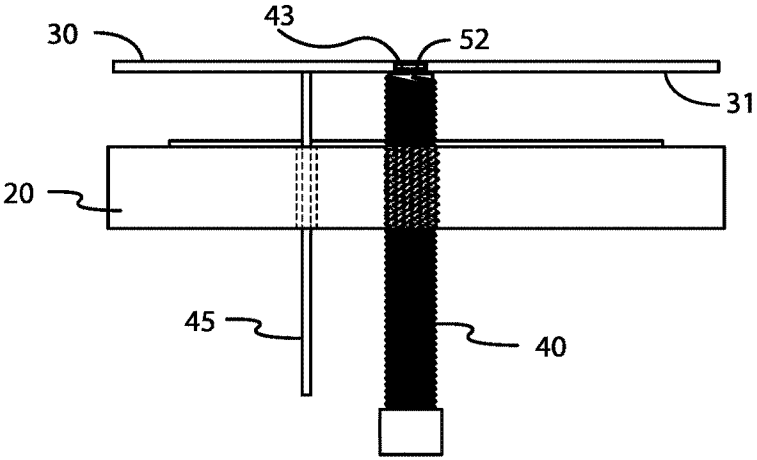
FIG. 25 is a top view of an adjustable razor assembly including the adjustable member of FIG. 24.
Figure 23:
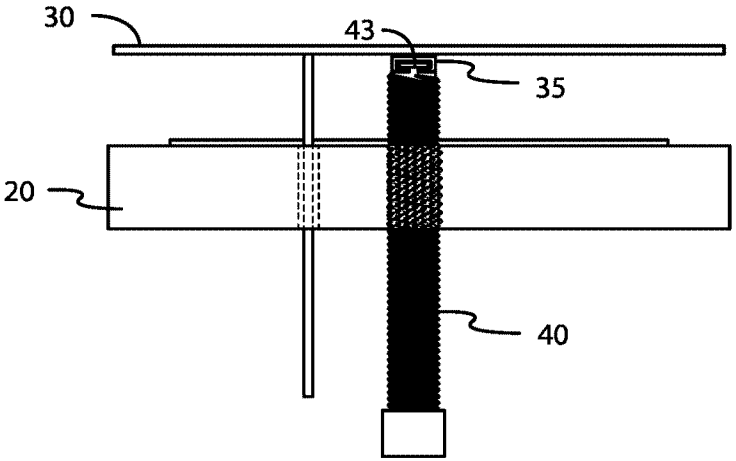
FIG. 23 is a top view of an adjustable razor assembly including the adjustable member of FIG. 22A.
Figure 28:
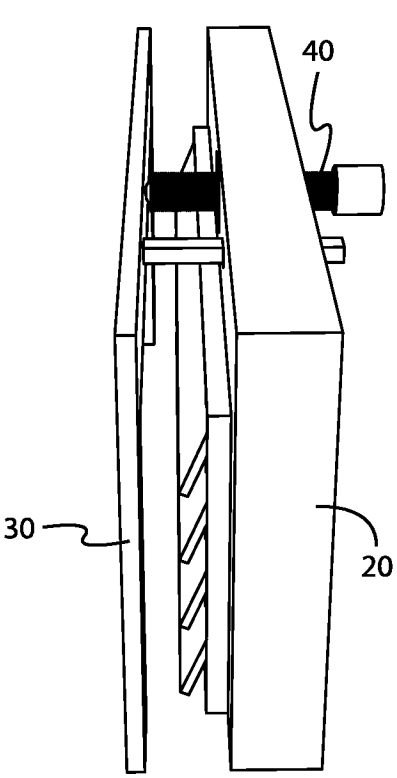
FIG. 28 is a perspective view of an adjustable razor assembly including the adjustable member of FIG. 26 and the actuation member of FIG. 27.
Figure 27:
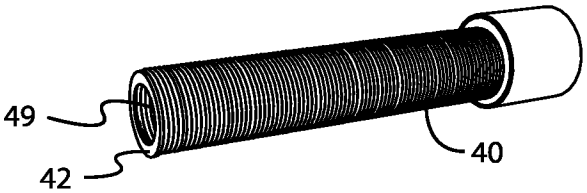
FIG. 27 is a perspective view of another embodiment of a turnable actuation member operationally configured for use with the adjustable member of FIG. 26.
Figure 29:
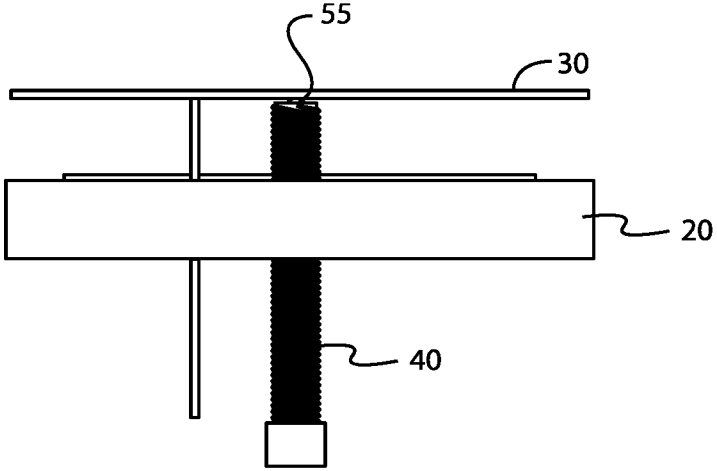
FIG. 29 is a top view of the adjustable razor assembly of FIG. 28.
Figure 26:
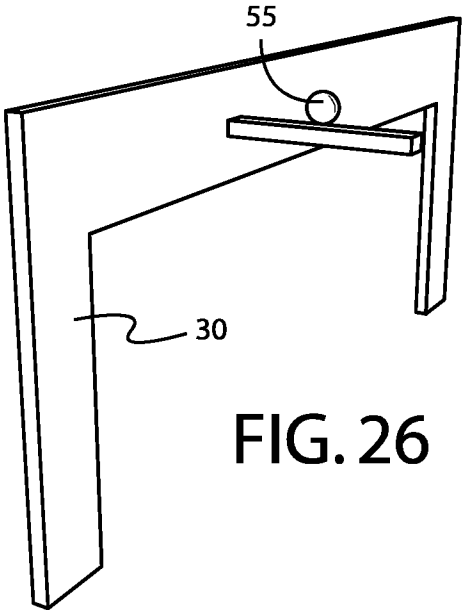
FIG. 26 is a perspective view of another embodiment of an adjustable member of the application.

In one embodiment, the above described connector pins 36 and 43 may be provided as snap-fit connection members or as threaded members providing a threaded connection. In another embodiment, the pins 36, 43 may be permanently attached members assembled during manufacturing for use as shown in the simplified embodiments of FIGS. 19-21. In still another embodiment, a receiving member 35 may include an open slot 35A (see FIGS. 22A, 22B, and 23) for inserting the second end 42 of the actuation member 40 (see Directional Arrow B) into the receiving member 35. In another embodiment as shown in FIGS. 24 and 25, the inner surface 31 may include a channel 52 or groove operationally configured to communicate with the cavity 50 for inserting the connector pin 43 into the cavity 50 (see Directional Arrow C).

Figure 60:
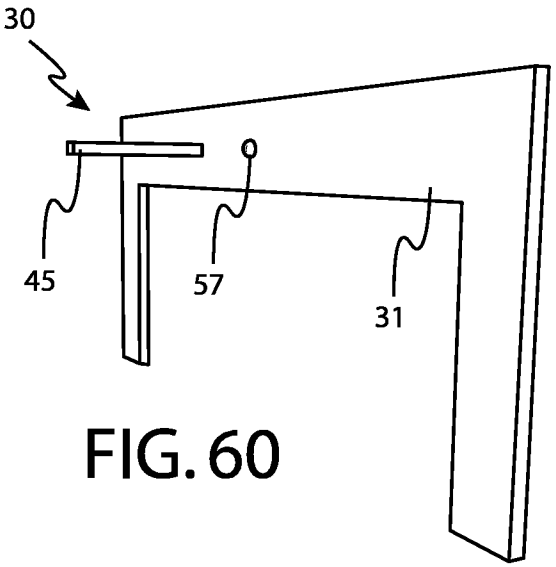
FIG. 60 is a perspective view of another embodiment of an adjustable member of the adjustable razor assembly.

With reference to FIGS. 26-29, in another embodiment an actuation receiving member of the adjustable member 30 may include a spherical member 55 (FIG. 26) for receiving an open second end 42 of a turnable actuation member 40 (FIG. 27) in a snap-fit configuration whereby the actuation member 40 may be turned clockwise and counter-clockwise about the spherical member 55. Similar as described above, the actuation member 40 may be provided as a hollow member for receiving the spherical member 55 or the second end 42 may include a cavity 49 effective for receiving at least part of the spherical member 55 in a snap-fit configuration therein. In addition, a stationary member 20 of this embodiment does not require a recessed area according to the snap-fit communication between the actuation member 40 and the spherical member 55. In still another embodiment, an actuation receiving member may be provided as a half sphere 57 (see FIG. 60) for communicating with the actuation member 40.

Figure 31A:
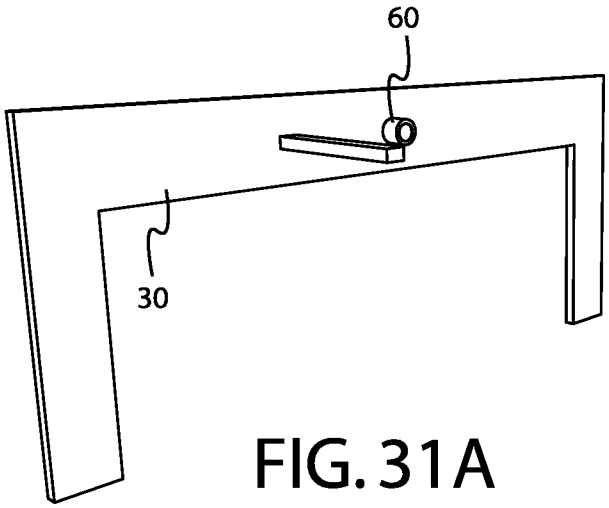
FIG. 31A is a perspective view of an adjustable member for use with the actuation member of FIG. 30.
Figure 30:
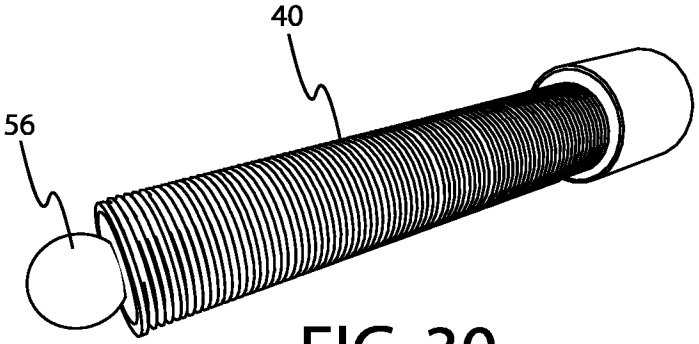
FIG. 30 is another embodiment of a turnable actuation member of this application.
Figure 33:
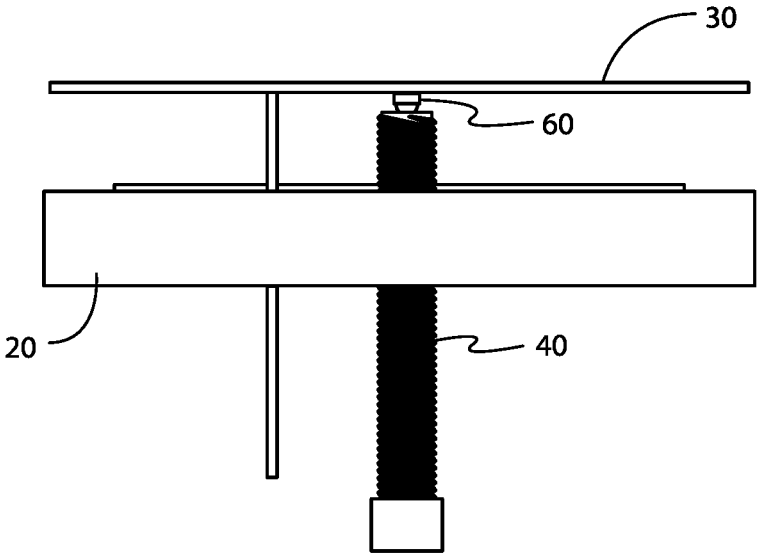
FIG. 33 is a top view of the adjustable razor assembly of FIG. 32.
Figure 61:
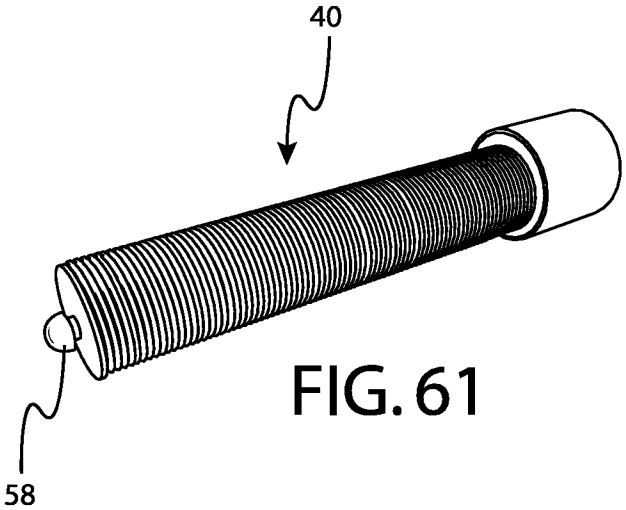
FIG. 61 is another embodiment of a turnable actuation member.

In another embodiment, a turnable actuation member 40 may be provided with a spherical member 56 at its second end 42 (see FIG. 30) operationally configured to snap-fit with a female member 60 extending out from the inner surface 31 of an adjustable member 30 as shown in FIG. 31A. The female member 60 is not limited to a particular size, but a minimum size is effective to hold at least half of the spherical member 56 therein during body shaver 10 operation (see FIG. 33). The spherical member 56 is not limited in size and may vary in relation to the size of the remaining sections of an actuation member 40. In still another embodiment, an actuation member 40 may be provided with a half sphere 58 (FIG. 61) as desired.

Figure 31B:
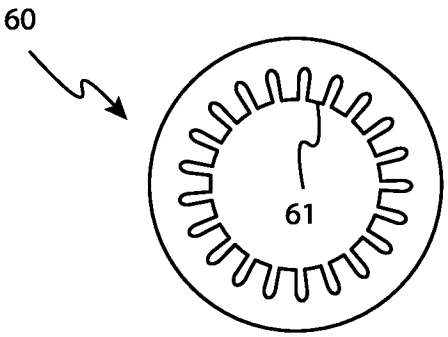
FIG. 31B is front view of another embodiment of a female member of the adjustable member of FIG. 31A.
Figure 32:
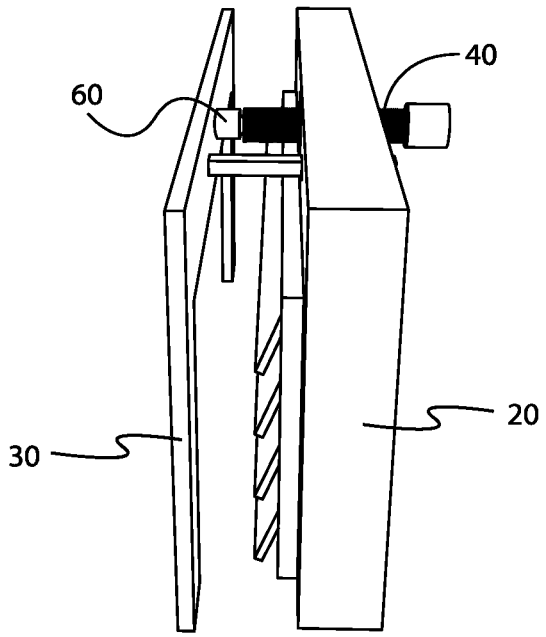
FIG. 32 is a perspective view of an adjustable razor assembly including the actuation member of FIG. 30 and the adjustable member of FIG. 31.

For purposes of this application, snap-fit connections described herein may be realized by providing a spherical member 55, 56 having an outer diameter slightly less than (1) the inner diameter of the cavity 49 of the actuation member 40 or (2) inner surface of the female member 60 allowing for a snug but rotatable fit. In another embodiment, the outermost edge or portion of a cavity 49 or opening of the female member 60 may include an inward extending lip 61 or other inward raised surface configuration along the perimeter of the cavity 49 or opening of the female member 60 defining an inner diameter less than the diameter of the corresponding spherical member 55, 56 and cavity 49 whereby the spherical member 55, 56 may be directed with force passed the lip 61 or inward raised surface and maintained within the open second end 42 or female member 60 for turnable operation until the actuation member 40 is removed under force. In one embodiment, a lip 61 may define a continuous perimeter. In another embodiment, the lip 61 may include a non-continuous or sectional perimeter extending radially inward as shown in the simplified illustration of FIG. 31B. A perimeter as shown in FIG. 31B may promote ease of insertion and/or removal of a spherical member 55, 56. As understood by the skilled artisan, it is further contemplated that the various embodiments of connections discussed herein in regard to a turnable actuation member 40 may be combined as desired, including one or more changes or alterations to the actuation member 40 and/or the adjustable member 30 as may be desired.

Figure 34:
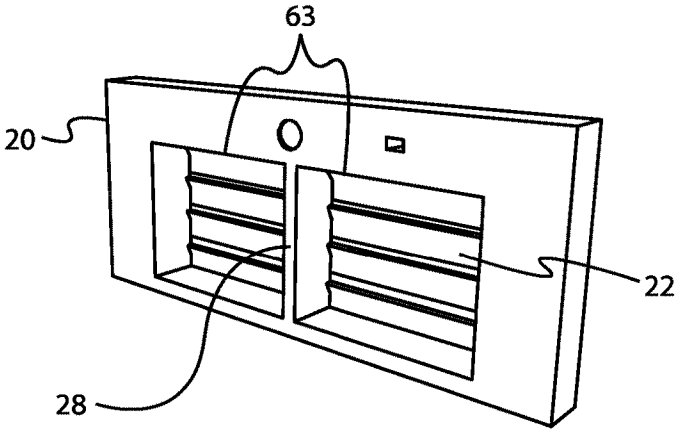
FIG. 34 is a rear perspective view of another embodiment of a stationary member of an adjustable razor assembly.

Still other embodiments of the body shaver 10 are contemplated herein. For example, a stationary member 20 may include two or more windows 63 (see FIG. 34) for passing a different set of blade members 22 through each window 63. The window divider 28 disposed there between may provide structural strength to the stationary member 20. In addition, the window divider 28 may act as a support for the blade members 22 preventing undesired bending and/or displacement of the blade members 22 during body shaver 10 operation. Depending on the intended use, a body shaver 10 having two or more windows 63 may also be easier to clean for reuse than a single window embodiment of the body shaver 10.

Figure 35:
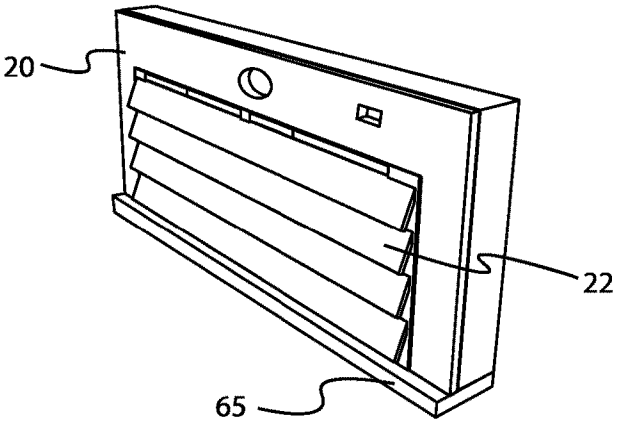
FIG. 35 is a perspective view of another embodiment of a stationary member of an adjustable razor assembly.

With reference to FIG. 35, the body shaver 10 may also include one or more skin guard members 65 operationally configured to smooth or stretch out a user's skin, improve comfort, protect against skin cuts and/or skin irritation, and combinations thereof. As shown in FIG. 35, a suitable skin guard member 65 may be disposed along the base of the stationary member 20 protruding out there from a distance as shown. In one embodiment, one or more skin guard members 65 may be provided as removable members. In another embodiment, one or more skin guard members 65 may be provided as a permanent part of a one-piece stationary member 20. In one embodiment, one or more skin guard members 65 may be constructed from like material(s) as the stationary member 20. In another embodiment, one or more skin guard members 65 may be constructed from one or more material(s) different from the stationary member 20. In another embodiment, one or more skin guard members 65 may be constructed from one or more malleable materials.

Without limiting the invention, the body shaver 10, i.e., the handle 12, stationary member framework 21 and adjustable member 30, may be manufactured from one or more materials as desired or as required according to regional laws and/or regulations. Suitable materials of construction may include, but are not necessarily limited to metals, metal alloys, polymeric materials, wood, cardboard, composite materials, ceramics, and combinations thereof. In one embodiment, a handle 12 may comprise one or more materials heavier than the corresponding stationary member 20 and/or adjustable member 30. In one exemplary embodiment, a handle 12 may be constructed from one or more metals. As an example, a handle 12 may be constructed of die casted metal and/or include metal inserts to increase the weight of the handle 12. In addition, a handle 12 may include a grip portion for handling during use. The grip portion may include one or more enhanced or augmented gripping materials, enhanced or augmented gripping region, textured type surfaces or outer skins effective to assist a user in holding the body shaver 10 during use. A suitable enhanced gripping material may include, but is not necessarily limited to rubber, gel, plastic, and like materials characterized by a tacky or sticky type outer surface. A textured surface may include, but is not necessarily limited to a knurled surface, a grooved surface, a ribbed surface, and combinations thereof.

In one suitable embodiment, a handle 12 may include a central longitudinal plane. In another embodiment, a handle 12 may include a non-linear or curved portion. Likewise, a handle 12 may be comprised of a plurality of linear sections connected in a manner providing a nonlinear handle 12. In another embodiment, a handle 12 may include an essentially S-shaped curved configuration and/or tongue-like widened portion as described in U.S. Pat. No. 5,031,319 entitled "Wet razor," the contents of which is herein incorporated by reference in its entirety.

Figure 36:
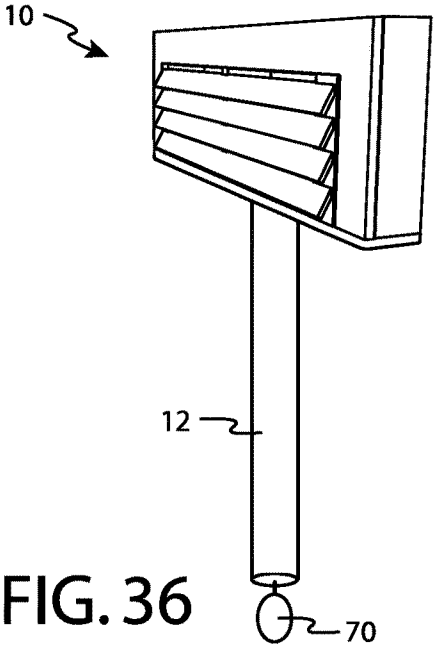
FIG. 36 is a perspective view of another embodiment of a body shaver.

Turning to FIG. 36, a body shaver 10 may also include a loop 70 at a second end of the handle 12 for hanging or suspending the body shaver 10. As shown, one suitable loop 70 may include a continuous perimeter, or closed perimeter, as shown in FIG. 36. Exemplary loop 70 shapes include, but are not necessarily limited to circular, oval, multi-sided shapes. In another embodiment, a loop 70 may be provided as an open hook type configuration or J-shape configuration. In the alternative, a piece of rope or string, e.g., nylon rope or string, as understood by persons of ordinary skill in the art of hanging hand held instruments, hand tools, and similar objects may be employed.

The skilled artisan will appreciate that a stationary member 20 of this application may be pivotally connected to a handle 12 in one or more modes of operation similar as other commercially available wet shavers. A stationary member 20 may also be pivotally connected to a handle 12 via a hinge or spherical snap-fit connection similar as discussed above. It is also contemplated that one or more embodiments described herein may include a stationary member 20 removably attachable to a handle 12 providing a body shaver 10 having a replaceable adjustable razor assembly 13 similar as other commercially available wet shavers.

In one non-limiting embodiment, a handle 12 may be provided with a connecting end or connecting member operationally configured to releasably attach to a corresponding stationary member 20 as described in U.S. Pat. No. 9,193,080 entitled "Shaving blade unit with self-leveling trimmer," the contents of which is herein incorporated by reference in its entirety. In another implementation, a handle 12 may include a head portion operationally configured to releasably attach to a corresponding stationary member 20 as described in United States Patent Application Number 20120124840A1 entitled "Wet Shaver," the contents of which is herein incorporated by reference in its entirety. In another implementation, a handle 12 may include a head portion operationally configured to releasably attach to a corresponding stationary member 20 as described in U.S. Pat. No. 7,526,869 entitled "Razor handle," the contents of which is herein incorporated by reference in its entirety. In another implementation, a handle 12 may include a head portion operationally configured to releasably attach to a corresponding stationary member 20 as described in U.S. Pat. No. 6,434,839 entitled "Safety razor," the contents of which is herein incorporated by reference in its entirety. In another implementation, a handle 12 may include a head portion operationally configured to releasably attach to a corresponding stationary member 20 as described in U.S. Pat. No. 8,844,145 entitled "Razor handle for a retractable shaving cartridge and a razor comprising such a razor handle," the contents of which is herein incorporated by reference in its entirety. In another implementation, a handle 12 may include a head portion operationally configured to releasably attach to a corresponding stationary member 20 as described in U.S. Pat. No. 5,784,790 entitled "Shaving razor and method," the contents of which is herein incorporated by reference in its entirety. In another implementation, a handle 12 may include a head portion operationally configured to releasably attach to a corresponding stationary member 20 as described in U.S. Pat. No. 4,514,904 entitled "Razor handle," the contents of which is herein incorporated by reference in its entirety. In another implementation, a handle 12 may include a cartridge support structure operationally configured to releasably attach to a corresponding stationary member 20 as described in U.S. Pat. No. 9,533,424 entitled "Razor handle," the contents of which is herein incorporated by reference in its entirety. In another implementation, a handle 12 may include a head portion operationally configured to releasably attach to a corresponding stationary member 20 as described in U.S. Pat. No. 4,587,729 entitled "Safety razor," the contents of which is herein incorporated by reference in its entirety.

Figure 37:
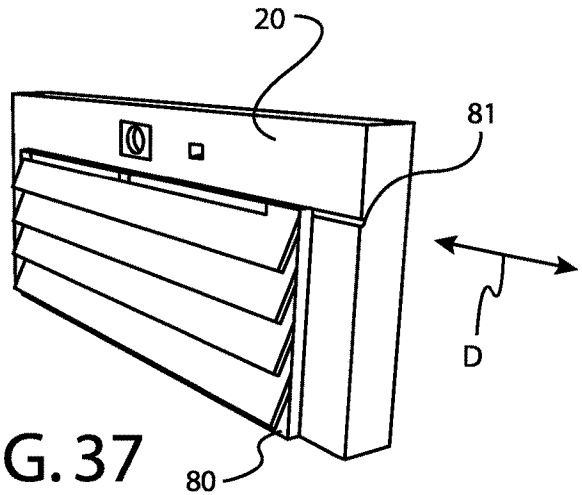
FIG. 37 is another embodiment of a stationary member including a removable razor assembly.

With attention to FIG. 37, a body shaver 10 may be provided with a removable and/or replaceable blade assembly 80 slid on and off of stationary member 20 laterally. In this embodiment, a blade assembly 80 suitably includes one or more lips, protrusions, teeth or raised members along an uppermost edge operationally configured to engage a channel 81 or groove dispose along the stationary member 20—the blade assembly 80 being slidable across the stationary member 20 according to Directional Arrow D. In another embodiment, the surface of the stationary member 20 may include one or more apertures operationally configured to receive one or more male members or projections disposed along a blade assembly 80 in a mated snap-fit position.

Figure 38:
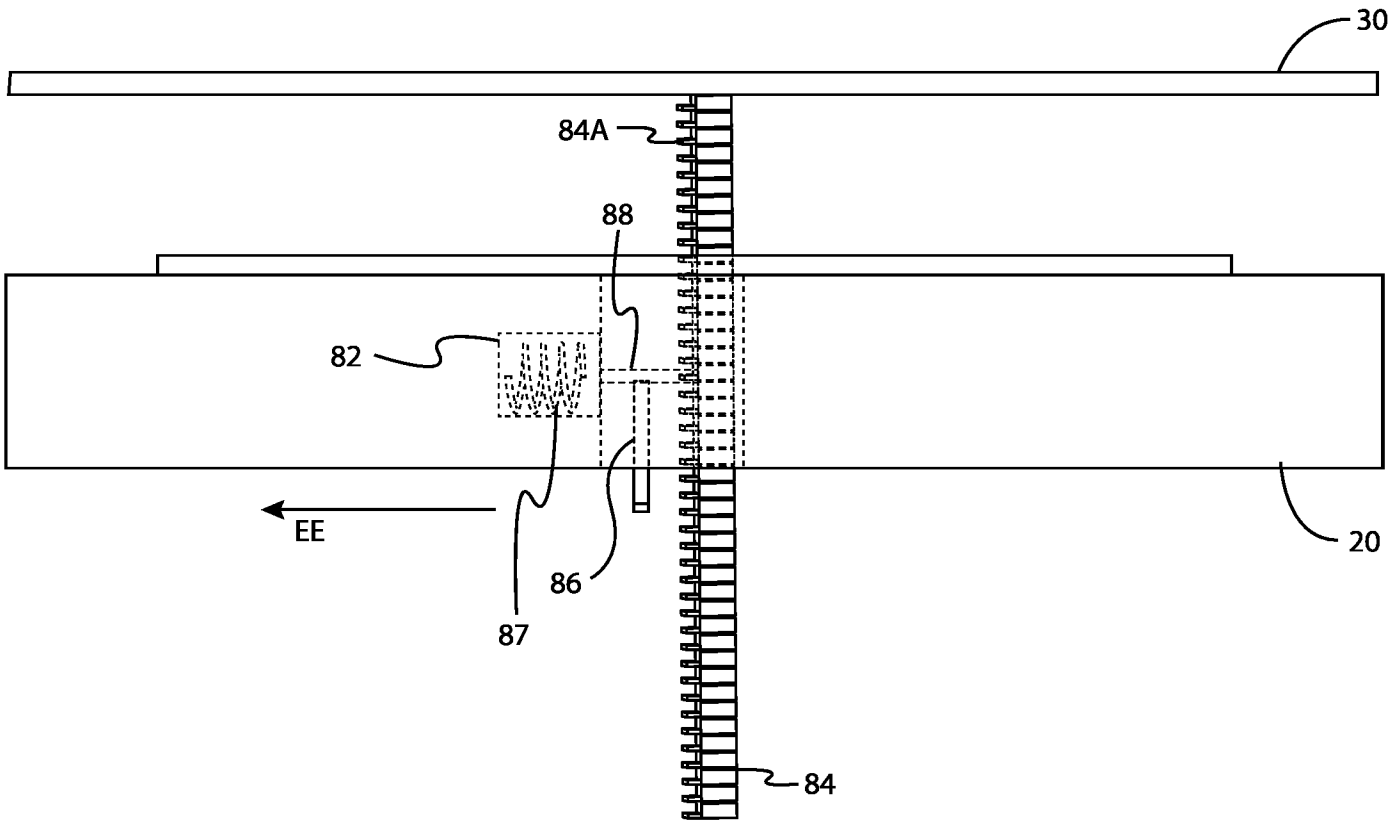
FIG. 38 is a top view of another embodiment of an adjustable razor assembly.
Figure 40:
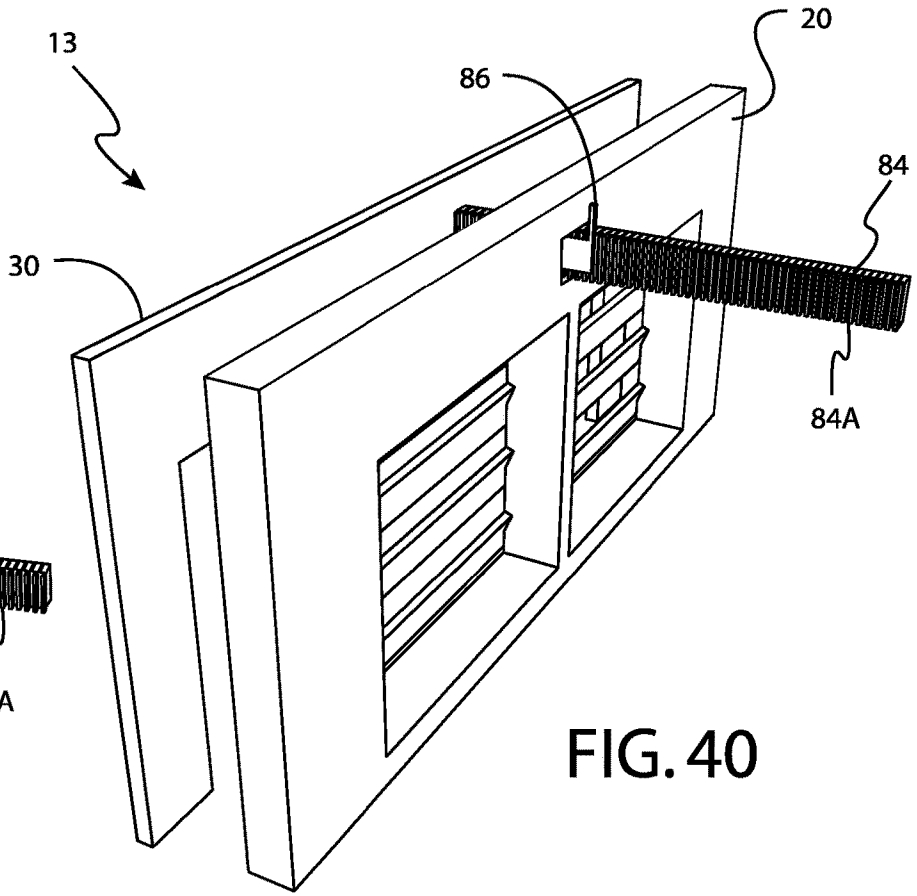
FIG. 40 is a perspective view of an adjustable razor assembly including the actuation member of FIG. 39.
Figure 39:
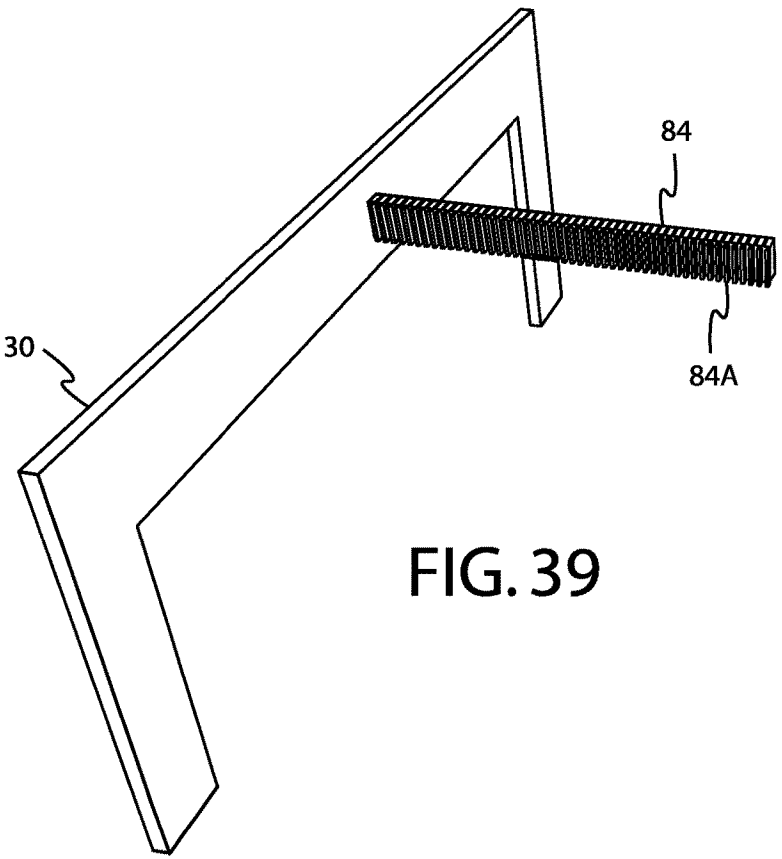
FIG. 39 is a perspective view of an embodiment of an adjustable member and a segmented actuation member.

Turning to FIGS. 38-42, in another embodiment an actuation member 40 may be provided as a non-turnable slotted or segmented member. In this embodiment, actuation may be provided via an assembly including an elongated member 84 defined by a segmented surface (see FIG. 39) and a corresponding pin assembly 85 located within the body of the stationary member 20 operationally configured to communicate with the segmented surface of the elongated member 84. In this embodiment, the elongated member 84 (or "segmented member") is defined by a plurality of notches 84A operationally configured to receive part of the pin assembly 85 in communication between adjacent notches 84A. With attention to FIG. 41, a suitable pin assembly 85 includes an external arm member 86 extending out a desired length for manually disengaging the pin member 88 out from the elongated member 84 (see Directional Arrow E in FIG. 38). The pin assembly 85 may also include a resilient member 87 attached thereto or located adjacent the pin assembly 85 that is operationally configured to be housed within a hollow chamber or area 82 of the stationary member 20 as shown in FIG. 38 (see also area 82 in FIG. 42). Suitably, the resilient member 87 is operationally configured to bias the pin member 88 toward the elongated member 84 in a manner effective to maintain the elongated member 84 in a fixed position between notches 84A during operation of the body shaver 10. In this embodiment, the elongated member 84 may be removably attached to the adjustable member 30 or it may be provided as a fixed part of the adjustable member 30. Although the notches 84A are shown extending out horizontally from the elongated member 84 toward the center of the adjustable member 30, it is contemplated that the notches 84A may be located along the opposite side of the elongated member 84. It is further contemplated that the elongated member 84 may include notches 84A on multiple sides or surfaces whereby the notched assembly may include additional pin assemblies 85 corresponding to the additional notched sides or surfaces.

Figure 41:
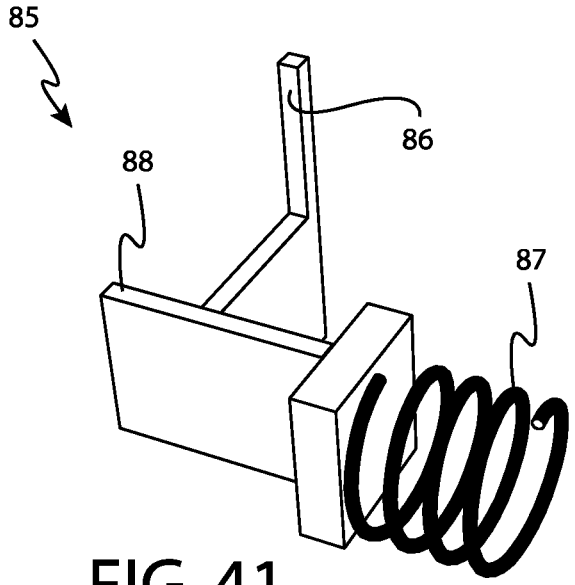
FIG. 41 depicts an embodiment of a pin assembly corresponding to the adjustable razor assembly of FIG. 40.
Figure 42:
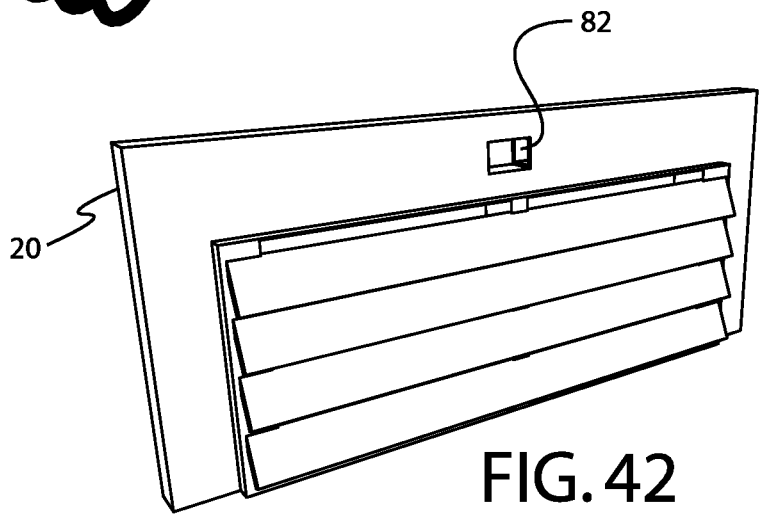
FIG. 42 is a perspective view of a stationary member corresponding to the adjustable razor assembly of FIG. 40.

With particular attention to FIGS. 38 and 41, the notches 84A of the elongated member 84 and the pin member 88 may be provided as planar type members, the notches 84A being defined by surfaces having right angles in regard to the planar surface of the elongated member 84 that the notches 84A extend out from. In another embodiment, one or more of the various surfaces defining the notches 84A and/or the pin member 88 may include curved or rounded surfaces. Likewise, the external arm member 86 is not limited to any one size or shape but is operationally configured to act as a lever for engaging and disengaging the pin member 88.

Figure 46:
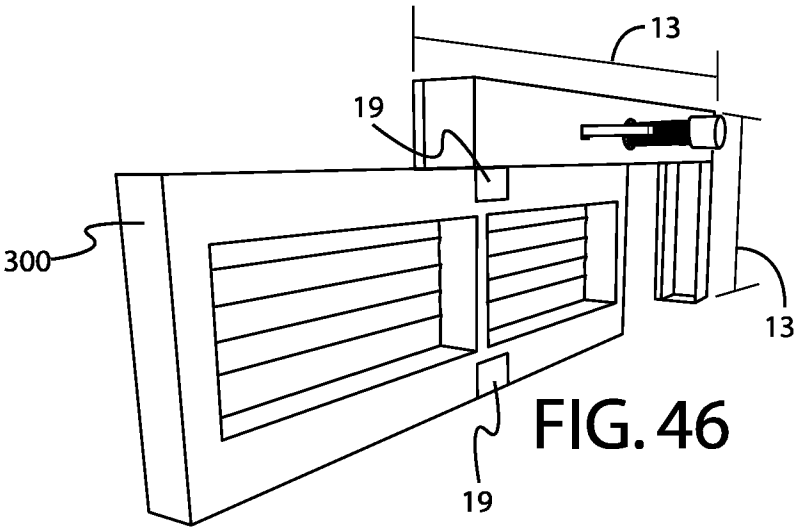
FIG. 46 is a rear perspective view of another embodiment of an adjustable razor assembly of the application illustrating its interaction with a commercially available shaving head.
Figure 47:
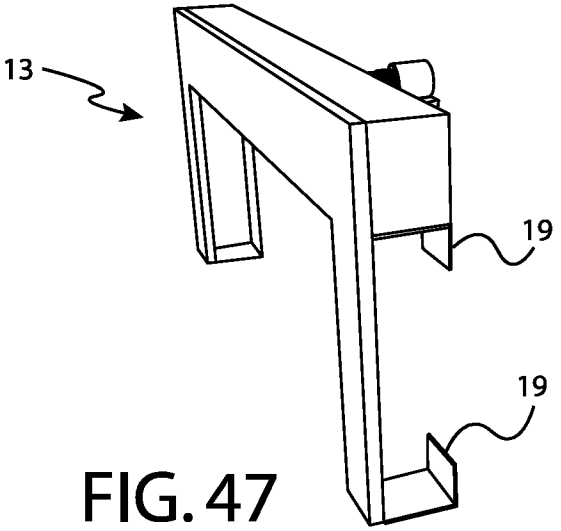
FIG. 47 is a perspective view of the adjustable razor assembly of FIG. 46.

In another embodiment as shown in FIGS. 46-47, the adjustable razor assembly 13 may be operationally configured to work in conjunction with one or more commercially available shavers. In this embodiment, the adjustable razor assembly 13 may be operationally configured to slide onto the shaving head 300 of one or more commercially available shavers. As shown, the adjustable razor assembly 13 may include guides 19, clamps, hooks or other types of appendage type members for engaging the upper and lower surfaces of the shaving head 300 in a slip-on manner.

In another embodiment a segmented actuation member 40 may be provided with notches 84A extending in a vertical direction as opposed to a horizontal direction as described above. Referring to the simplified embodiment of FIGS. 48-51, another actuation member 40 may be provided as an assembly including an elongated notch member 90 and a corresponding case 91. Suitably, the case 91 is attached to the adjustable member 30 and operationally configured to receive the notch member 90 therein and bias the notch member 90 vertically (see Directional Arrow F) in a manner effective to interact with a pin assembly 85 of a stationary member 20.

Figure 49:
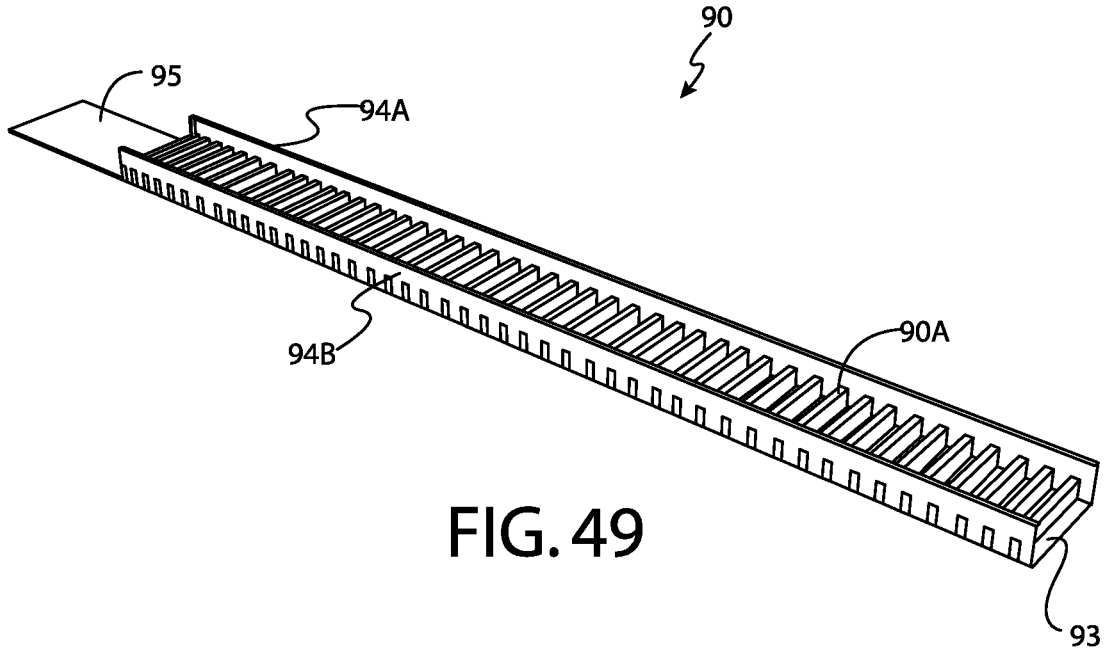
FIG. 49 is a perspective view of an embodiment of an elongated notched member of an actuation assembly.

As shown in FIG. 49, one suitable notch member 90 may include an elongated rectangular base 93 defined by side walls 94A, 94B and a plurality of notches 90A there between, each notch 94A extending vertically from the base 93. In addition, the notch member 90 may include a handle 95 extending out from the base 93 effective for manual manipulation by a user.

Figure 50:
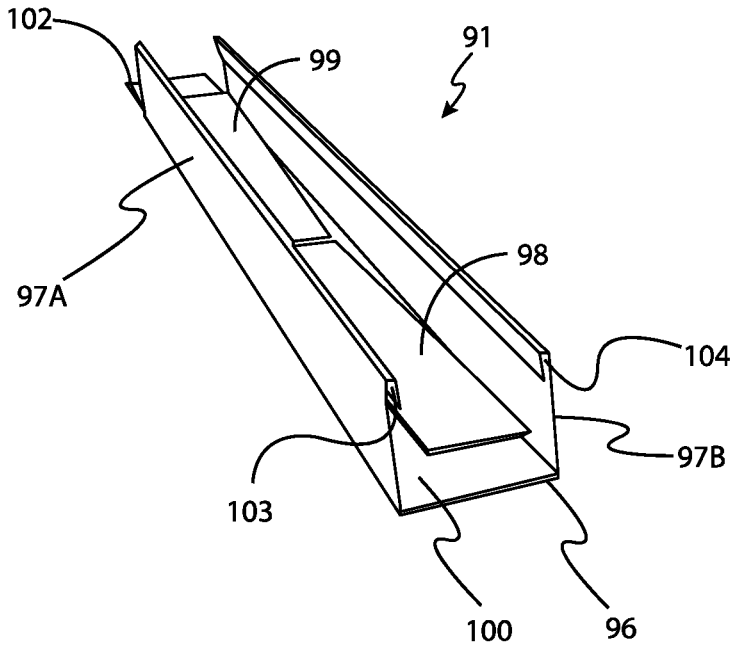
FIG. 50 is a perspective view of an embodiment of a case of an actuation assembly corresponding to the elongated notched member of FIG. 49.
Figure 51:
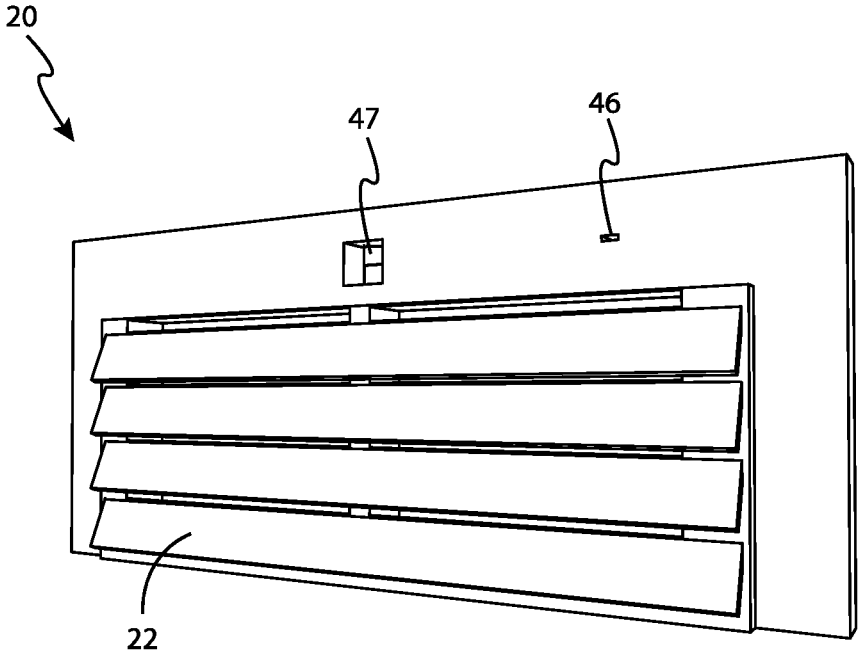
FIG. 51 is a perspective view of another embodiment of a stationary member of an adjustable razor assembly.

As shown in FIG. 50, one suitable case 91 operational with the notch member 90 of FIG. 49 includes a base 96 defined by side walls 97A, 97B and biasing members 98, 99 disposed between the side walls 97A, 97B and attached to the inner surface 100 of the base 96. In this embodiment, inner edges of the biasing members 98, 99 may be attached at or near a midpoint of the base 96 and extend outward at an angle relative to the inner surface 100 in a manner effective to provide biasing forces directionally to a notch member 90 according to Directional Arrow F. In one embodiment, inner edges of the biasing members 98, 99 may be attached to the inner surface 100 via spring loaded hinges. In another embodiment, the biasing members 98, 99 may be permanently adhered to the inner surface 100. For example, the base 96 and biasing members 98, 99 may be constructed from one or more metals and attached via welds and/or adhesives. In an embodiment where the base 96 and the biasing members 98, 99 are constructed from one or more polymeric materials, the biasing members 98, 99 may be attached to the inner surface 100 via heat energy. In still another embodiment, the case 91 may be provided as a one-piece construction.

Similar as the notch member 90, the case 91 may too be provided with a handle 102 extending out from the base 96 effective for manual manipulation by a user. As shown in FIG. 50, the upper edges of the side walls 97A, 97B may be turned inward in a manner effective to provide opposing linear slots 103, 104 operationally configured to receive side walls 94A, 94B of the notch member 90 therein when mating the notch member 90 to the case 91 (see Directional Arrow G). In operation, the biasing members 98, 99 suitably bias the notch member 90 so that the upper edges of the side walls 94A, 94B abutt the upper inner surfaces of the slots 103, 104.

Without limiting this embodiment to any one implementation, a suitable stationary member 20 includes first and second apertures 46, 47 operationally configured to receive the guide member 45 and an actuation member 40 there through as shown. With attention to FIG. 51, a stationary member 20 does not require a recessed area 48 as provided in FIG. 11.

Figure 52:
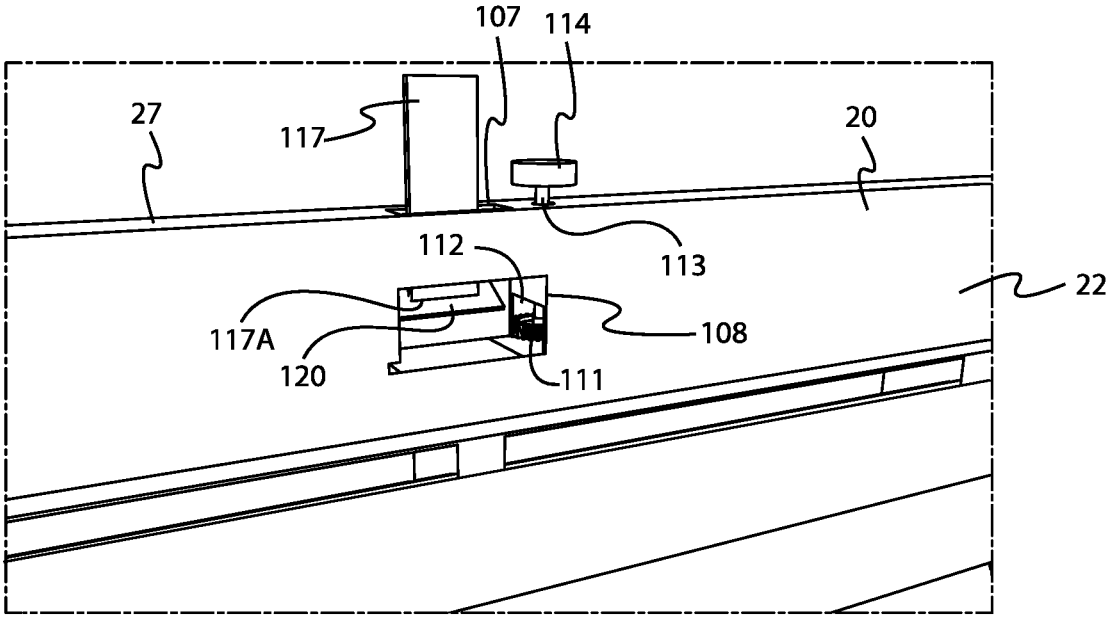
FIG. 52 is a partial perspective view of another embodiment of a stationary member of an adjustable razor assembly.
Figure 53:
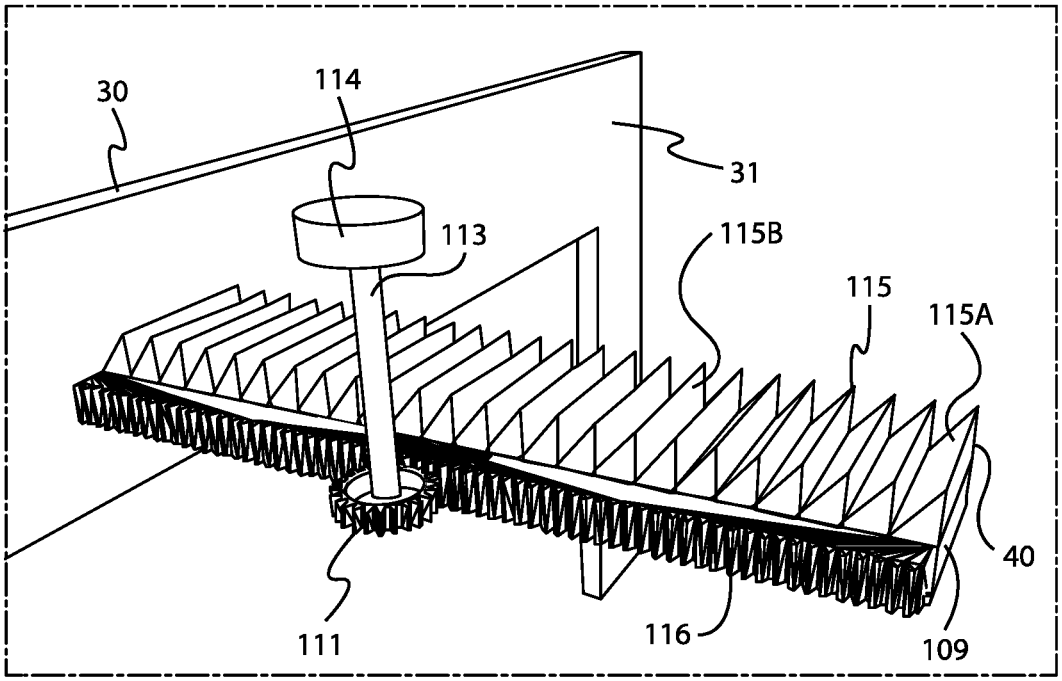
FIG. 53 is a partial perspective view of an embodiment of an adjustable member and part of an actuation assembly corresponding to the stationary member of FIG. 52.
Figure 54:
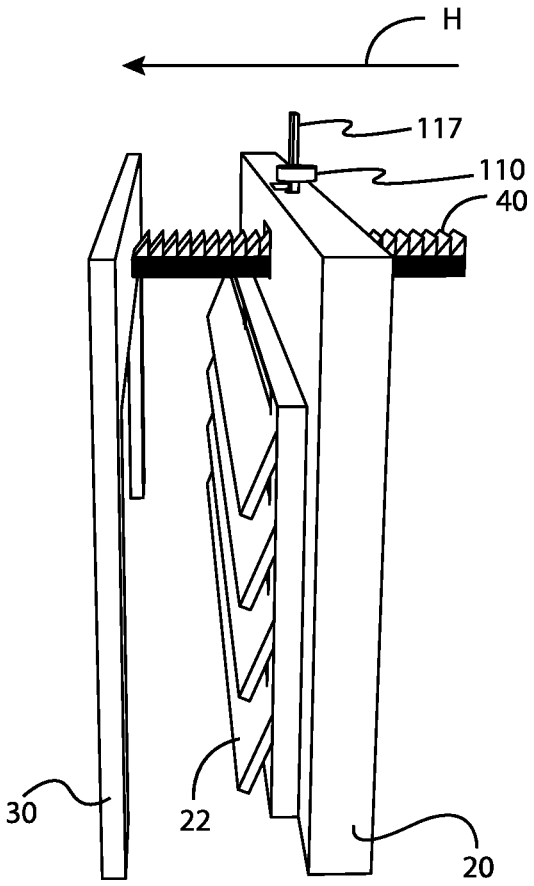
FIG. 54 is a perspective view of the adjustable razor assembly of FIGS. 52 and 53.

In still another embodiment the adjustable razor assembly 13 may include another segmented member variation for actuating the adjustable member 30, e.g., a rack and pinion gear assembly. Referring to FIGS. 52-54, the stationary member 20 of this embodiment includes a primary aperture 108 for receiving an actuation member 40 there through. With particular attention to FIG. 52, the stationary member 20 also includes an exposed chamber 112 adjacent the primary aperture 108 operationally configured to house a turn dial 110 (hereafter "dial 110") for communicating with the actuation member 40. One suitable dial 110 includes (1) a gear 111 at a first end that is housed within the chamber 112, (2) a shaft 113 extending coaxially from the gear 111 out from the chamber 112 through the stationary member 20 terminating in (3) a concentric external knob 114 operationally configured to manually turn the gear 111 clockwise and counter-clockwise.

Referring to FIG. 53, the actuation member 40 of this embodiment suitably includes a first end attached to the inner surface 31 of the adjustable member 30 and a second distal end terminating a desired distance from the inner surface 31. The actuation member 40 includes a base 109 defined by a first surface having a plurality of parallel notches 115 disposed in series as shown. In one embodiment, the notches 115 may include planar surfaces defining right angles with the first surface of the base 109. In the embodiment of FIG. 53, the notches 115 are provided as angled teeth type members.

Still referring to FIG. 53, the actuation member 40 of this embodiment also includes a second surface defined by a gear rack 116 operationally configured to communicate with the gear 111 in a manner effective to produce linear motion of the actuation member 40 and the adjustable member 30 as understood by persons of ordinary skill in the art of gears. The gear rack 116 may include a length as desired for a particular adjustable razor assembly 13 including, but not limited to a length up to substantially similar as the length of the base 109.

Figure 55:
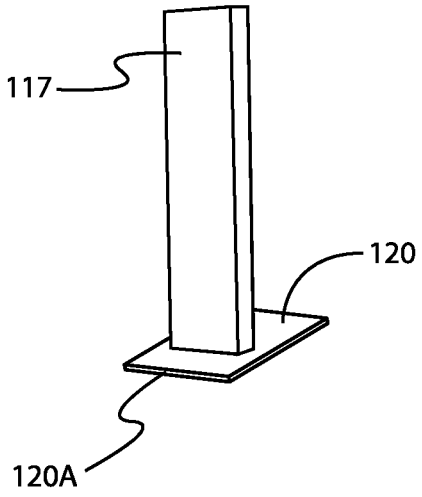
FIG. 55 is a perspective view of an embodiment of an actuation control member and catch plate attached thereto.
Figure 56:
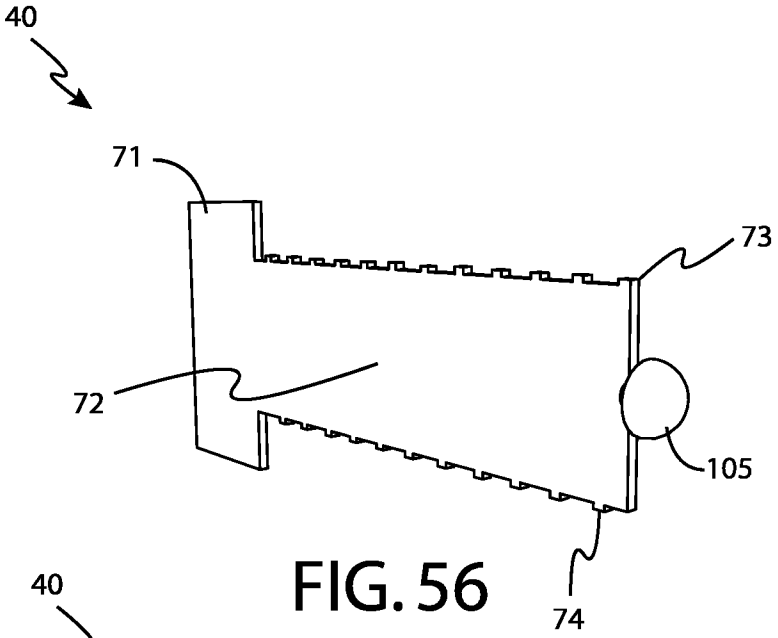
FIG. 56 is another embodiment of a turnable actuation member.
Figure 57:
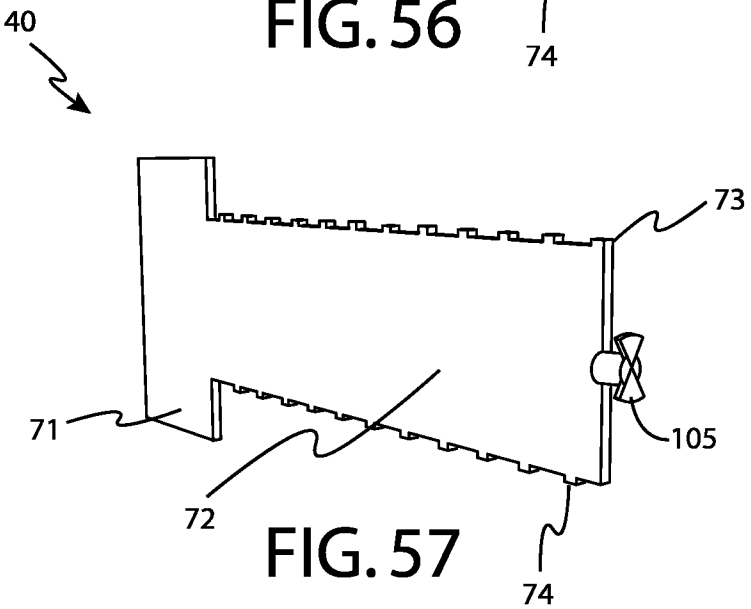
FIG. 57 is another embodiment of a turnable actuation member.
Figure 58:
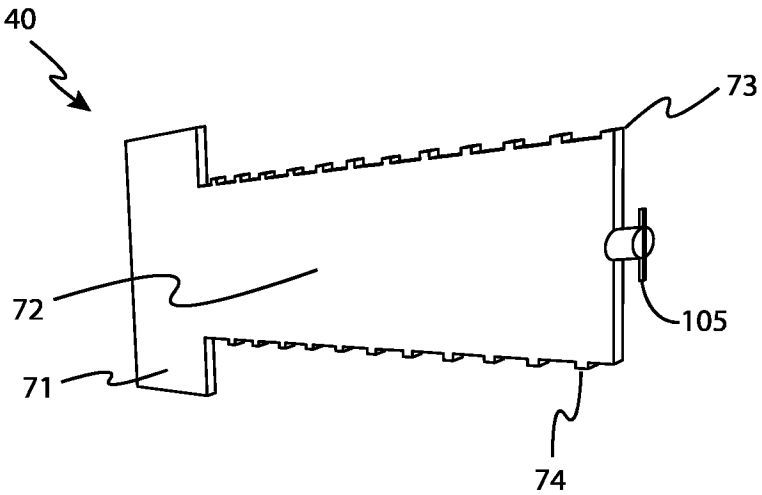
FIG. 58 is another embodiment of a turnable actuation member.
Figure 59:
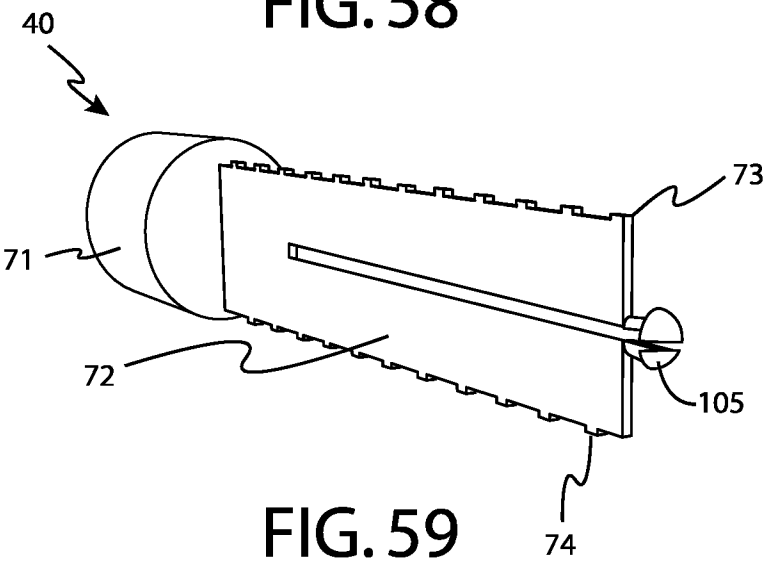
FIG. 59 is another embodiment of a turnable actuation member.

Referring again to FIG. 52, the stationary member 20 also includes another aperture 107 extending from a third surface 27 to the primary aperture 108, aperture 107 being operationally configured to receive an actuation control member 117 there through. In one embodiment, the actuation control member 117 may be operationally configured to engage the notches 115 for holding the actuation member 40 in a fixed position. As FIG. 52 illustrates, the stationary member 20 may also include a planar type catch plate 120 attached to the stationary member 20 disposed within the primary aperture 108. As shown in FIG. 55, the actuation control member 117 may be attached to the catch plate 120 in a manner whereby the actuation control member 117 may direct the distal edge 120A of the catch plate 120 to an engagement position with the notches 115. Likewise, the actuation control member 117 may be manually directed away from the notches 115 to a disengagement position apart from the actuation member 40 allowing linear movement of the actuation member 40 through the primary aperture 108. As shown, the actuation control member 117 may include a planar rectangular member including side edges set within grooves of the secondary aperture 107 for linearly guiding and holding the actuation control member 117. In another embodiment, the actuation control member 117 may include a biasing member, e.g., a spring, operationally configured to bias the actuation control member 117 directionally toward an engagement position with the notches 115. Other actuation control member 117 and catch plate 120 configurations are contemplated herein for engaging notches 115 and fixing the actuation member 40 in a static position, e.g., a three-sided member, a member having a curved perimeter, a shaft type pin member.

With attention to FIGS. 56-59, other turnable actuation members 40 may be provided with a handle 71, middle portion 72 having a key type configuration as opposed to a cylindrical threaded shaft 44 as discussed above. In such embodiments, the middle portion 72 may include opposing raised members 73, 74 (hereafter referred to as "teeth") provided in an offset arrangement as shown. In another embodiment, opposing teeth 73, 74 may be provided in an aligned arrangement.

Suitably, the teeth 73, 74 have dimensions that allow the teeth 73, 74 to engage or fit within the threaded pathway of the perimeter of the second aperture 47. In operation, a first tooth 73 located at the end of the middle portion 72 (tooth 73 is shown located along the upper end of the middle portion 72) engages the threads second aperture 47, once engaged the actuation member 40 may be turned through the threads in a screw type manner—the first opposing tooth 74 engaging the threads once the actuation member has made a half turn 180.0 degrees. As another half turn occurs, the second upper tooth engages the threads and so on until the actuation member 40 has been directed through the second aperture 47 as desired. As shown in FIGS. 56-59, the connection end 105 of the actuation member 40 is not limited to any one particular configuration but is suitably provided to correspond with an operable receiving member 35 or the like on the adjustable member 30. In another embodiment, an opposite type configuration of the above description may be provided wherein one or more teeth are located along the perimeter of the second aperture 47 and corresponding teeth threads are located on the actuation member 40.

Figure 62:
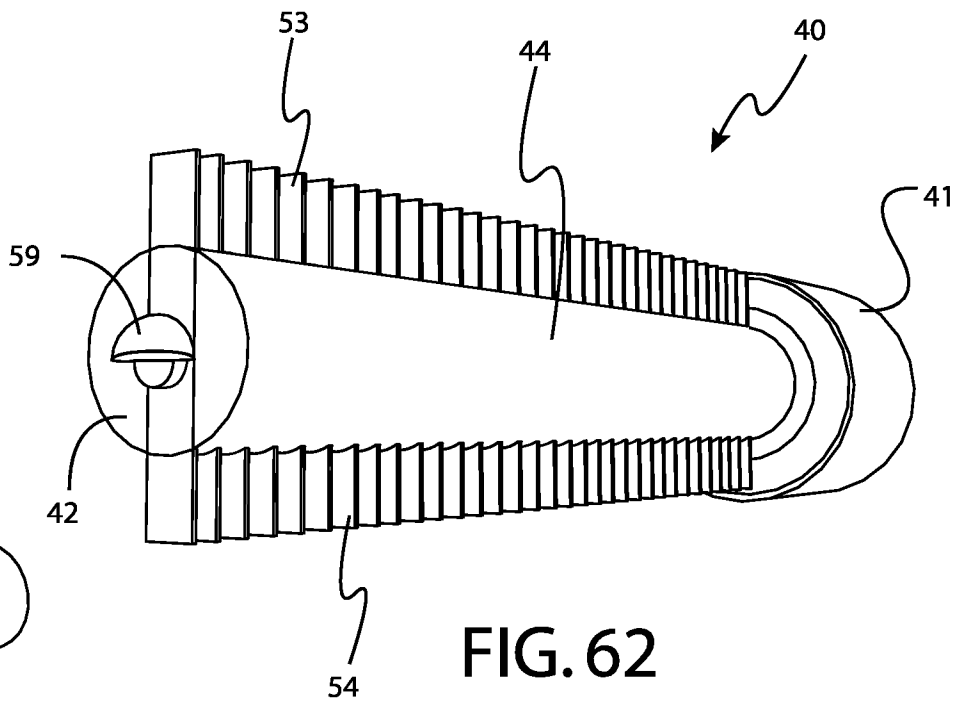
FIG. 62 is another embodiment of a turnable actuation member.
Figure 63:
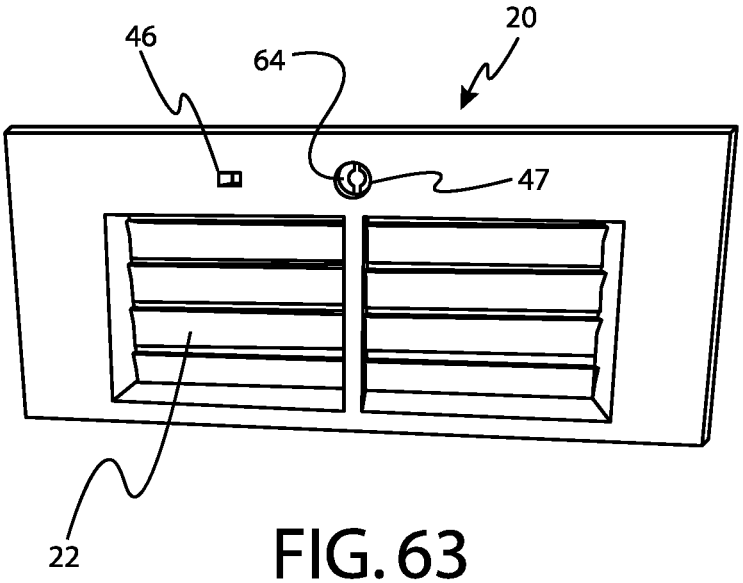
FIG. 63 is a rear perspective view of an embodiment of a stationary member of the adjustable razor assembly.
Figure 64:
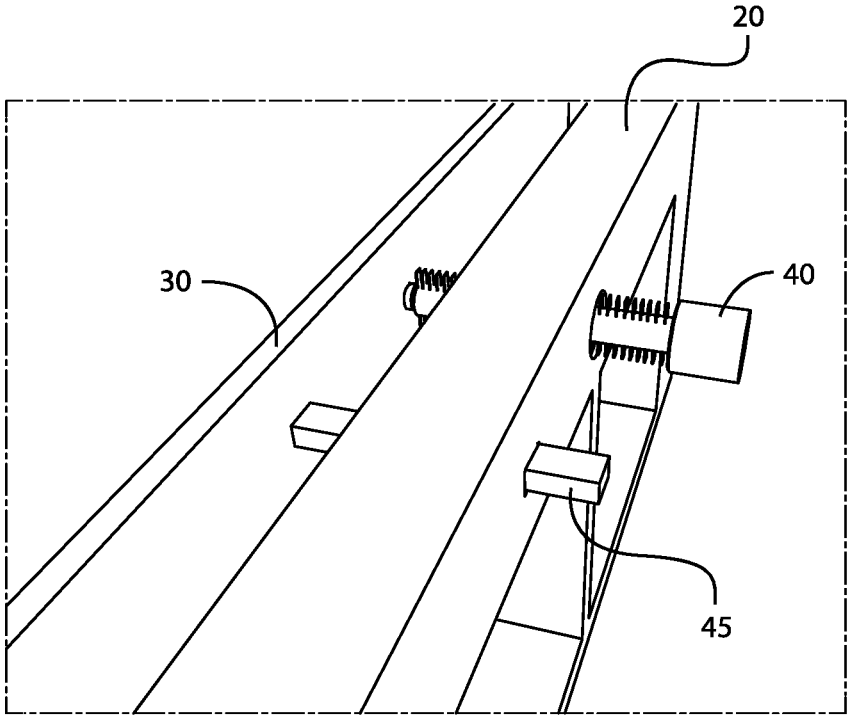
FIG. 64 is a partial perspective view of another embodiment of an adjustable razor assembly including the stationary member of FIG. 63.

With attention to FIGS. 62-64, in another embodiment actuation of the adjustable razor assembly 13 may be accomplished via an elongated segmented turnable actuation member 40 and a corresponding second aperture 47 configuration as shown. In this embodiment, the elongated shaft 44 includes a plurality of in-line raised members 53, 54 extending out 180.0 degrees along opposing sides of the elongated shaft 44. The inner surface of the second aperture 47 includes a planar body member 64 forming a two-winged opening configuration as shown that is operationally configured to receive the actuation member 40 there through when the raised member 53, 54 are aligned according to the shape of the two-winged opening of the body member 64, which is not limited to the orientation as shown. The embodiment of FIGS. 62-64 incorporates two positions of the actuation member 40, namely, (1) a locked position and (2) an adjustable position. As understood by the skilled artisan, a user may rotate the actuation member 40 to an adjustable position by aligning the raised members 53, 54 with the two-winged opening of the body member 64 and thereafter direct the actuation member 40 through the opening of the body member 64 in either direction to a desired position. To set the actuation member 40 to a locked position the actuation member 40 may be turned so that at least part of the body member 64 rests between adjacent raised members 53, 54 thereby obstructing the actuation member 40 from being moved through the second aperture 47. In one simplified embodiment, the actuation member 40 may be rotated about 90.0 so that the raised members 53, 54 extend out horizontally in reference to a body member 64 having vertically aligned wings as shown in FIG. 63. In one suitable embodiment, the thickness of the body member 64 may be substantially similar to the distance between adjacent raised members 53, 54 providing a snug fit of the body member 64 between adjacent raised members 53, 54.

In one embodiment, and depending on the configuration of the adjustable member 30, the actuation member 40 of FIGS. 62-64 may include a second end 42 defined by a connector pin 43, a spherical member 56 or a half sphere 58. As shown in FIG. 62, the actuation member 40 may also be provided as a quarter sphere 59. In such embodiment, a female receiving member 35 may be provided as a semi-circle or three-fourth (¾) circle rather than a complete cylindrical female opening. Suitably, a semi-circle or three-fourth (¾) circle is effective to limit the turnability of the actuation member 40 to less than 360.0 degrees between a locked position and an adjustable position. It is also contemplated that in another embodiment, a body member 64 may be provided with a single-winged opening there through and an actuation member 40 with only a single set of raised members—either raised members 53 or raised members 54.

Figure 65:
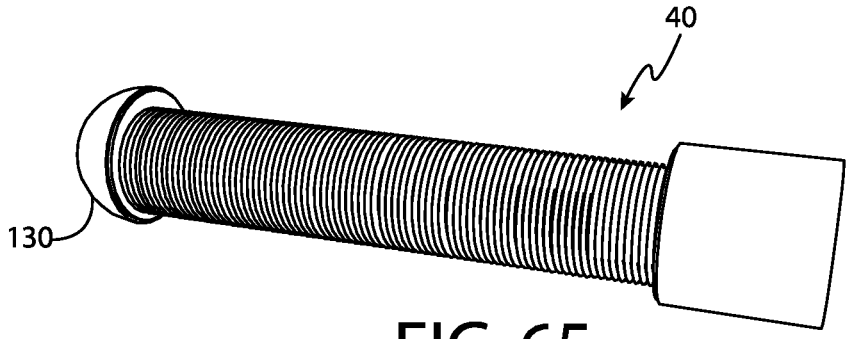
FIG. 65 is another embodiment of a turnable actuation member.
Figure 66:
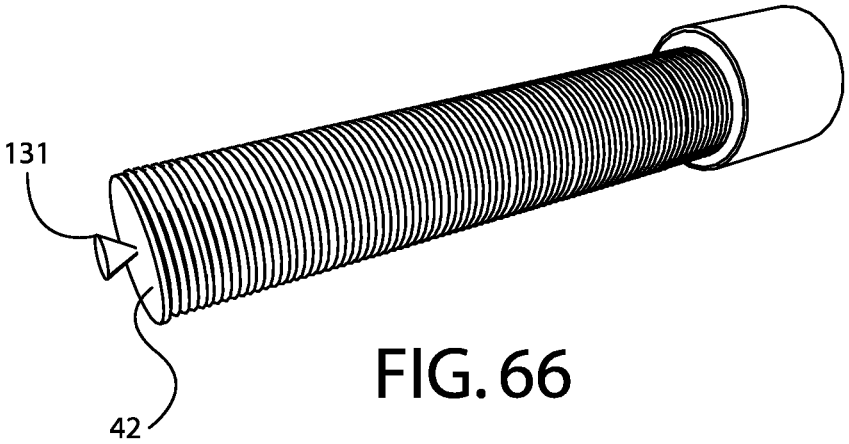
FIG. 66 is another embodiment of a turnable actuation member.
Figure 67:
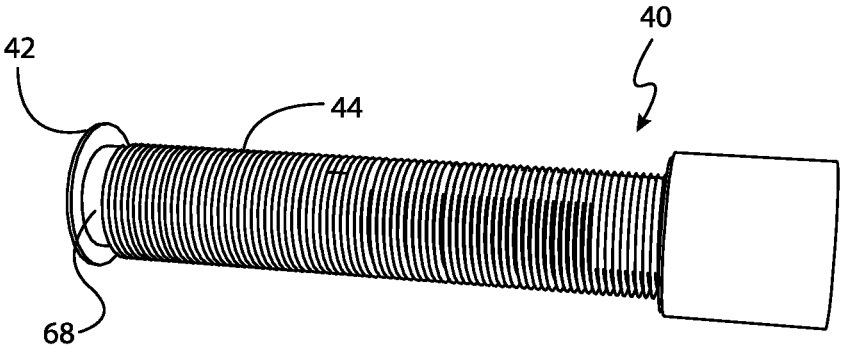
FIG. 67 is another embodiment of a turnable actuation member.

It should be noted that the communication between an actuation member 40 and an adjustable member 30 is not necessarily limited to the configurations described above, but may include other modes of connection and/or assemblies as understood and appreciated by persons of ordinary skill in the art of couplings, connecters, links, and the like. In another example, an actuation member 40 may be held in a static or fixed position during body shaver 10 operation via pressure, e.g, manual force, via an additional resilient member operationally configured to bias an actuation member 40 to a fixed position against part of the stationary member 20, one or more magnets for fixing an actuation member 40 in a fixed position. In another example, a turnable actuation member 40 may include a second end 42 defined by a half sphere 130 configuration as shown in FIG. 65. In another embodiment, a turnable actuation member 40 may include a second end 42 defined by a cone shaped member 131 extending out from the surface of the second end 42 as shown in FIG. 66. In still another embodiment, a turnable actuation member 40 of FIG. 10 may include an elongated shaft 44 with a smooth section or non-threaded section 68 adjacent the enlarged second end 42 (see FIG. 67) to promote turnability of the actuation member 40 when engaged with an adjustable member 30.

Figure 69:
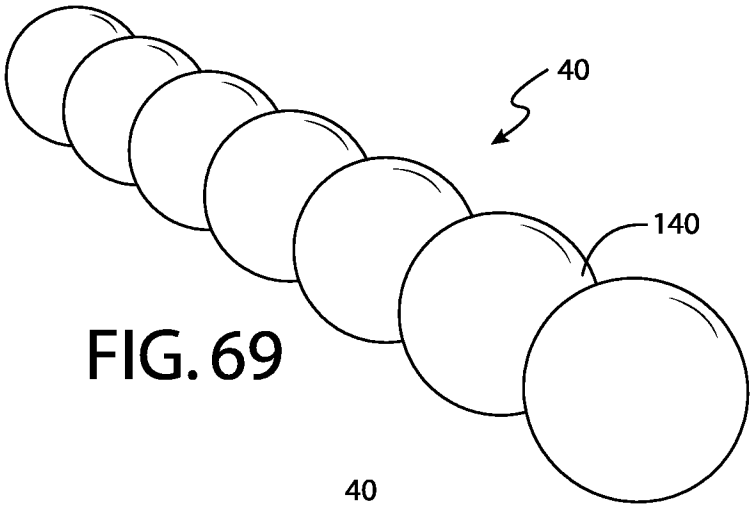
FIG. 69 is another embodiment of a segmented actuation member.
Figure 71:
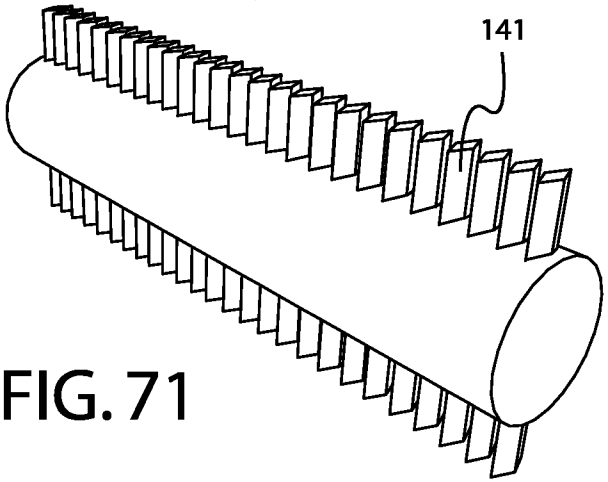
FIG. 71 is another embodiment of a segmented actuation member.
Figure 68:
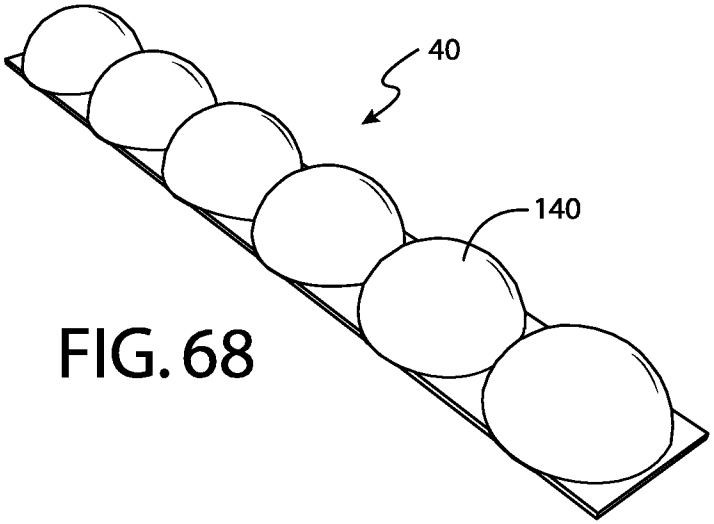
FIG. 68 is another embodiment of a segmented actuation member.
Figure 70:
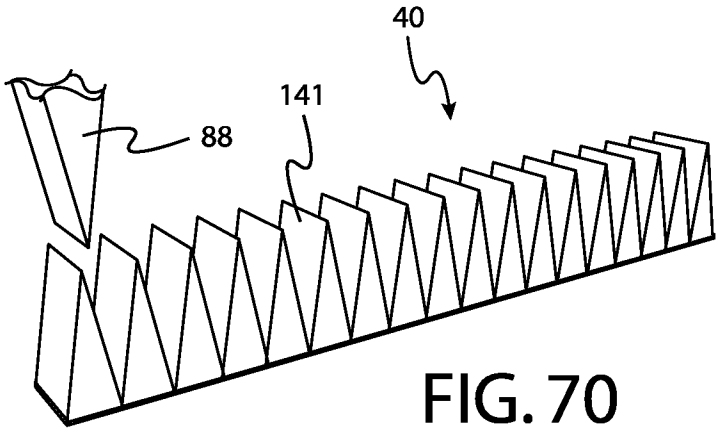
FIG. 70 is another embodiment of a segmented actuation member.

Likewise, other segmented actuation member 40 configurations are contemplated herein. For example, one or more actuation members 40 may be provided with rounded or curved segments and/or inclined segments operationally configured to guide or align a pin member 88 in a desired locked position between adjacent segments. Simplified embodiments of curved segment surfaces 140 are shown in FIGS. 68 and 69. Simplified embodiments of inclined segment surfaces 141 are shown in FIGS. 70 and 71.

In one suitable mode of operation, as an actuation control member 117 is set in an engagement position with notches 115, dial 110 may be turned counter-clockwise directing the adjustable member 30 apart from the stationary member 20—the angle of the notches 115 allowing the first end 117A of the actuation control member 117, or distal edge of the catch plate 120, to slip over each notch 115 as the actuation member 40 is directed through the aperture 108 according to Directional Arrow H (see FIG. 54). As such, the actuation control member 117, or catch plate 120, does not have to be directed to a disengagement position for the actuation member 40 to be directed according to Directional Arrow H. However, in an embodiment as shown in FIG. 53, including notches 115 having angled first surfaces 115A and right angle forming second surfaces 115B, in order to direct the adjustable member 30 toward the stationary member 20, i.e., opposite of Directional Arrow H, the first end 117A of the actuation control member 117, or distal edge of the catch plate 120, is suitably directed apart from the notches 115 of the actuation member 40 allowing the actuation member 40 to freely move back and forth unobstructed. In another embodiment, the directional layout of the angled surfaces of the notches 115 may be set in the opposite orientation as desired. Also in this particular embodiment, the configuration of the actuation member 40 is sufficient for the exclusion of a guide member 45 as shown, although a guide member 45 may be employed as desired.

In another suitable mode of operation, an adjustable member 30 may be set at a position relative the stationary member 20 according to the desired shaving results for one or more target shaving areas. As an example, if a user of the body shaver 10 desires a close shave, cutting a maximum amount of body hair, the adjustable member 30 is suitably set in an abutment position with the stationary member 20 allowing a maximum length of the blade members 22 to extend out beyond the adjustable member 30 as shown in FIG. 1. If a user desires to cut less than a maximum length of hair, e.g., to maintain a beard, goatee, side burns, and the like, the adjustable member 30 may be directed apart from the stationary member 20 as shown in FIG. 2, which distances the blade members 22 apart from a target shaving area thereby preventing the blade members 22 from cutting body hair to less a predetermined length. In other words, the closer the distance between the adjustable member 30 and the stationary member 20 the closer the shave. Said another way, when an adjustable member 30 is set apart from the stationary member 20 as shown in FIG. 2, the adjustable member 30 suitably contacts the shaving area of an individual's skin maintaining the blade members 22 apart from the shaving area.

In regard to setting the adjustable member 30 at a desired shaving position, the body shaver 10 may include a scale or other markings molded, etched or inked along the actuation member 40 and/or guide member 45 and/or stationary member 20 to enable a user to set the distance between the adjustable member 30 and the stationary member 20 as desired. For example, the body shaver 10 may be provided with recommended settings for shaving body hair types and/or lengths whereby recommended settings of the adjustable member 30 may be provided according to the nomenclature of the scale, e.g., numbers, letters, color schemes, and combinations thereof.

Figure 43:
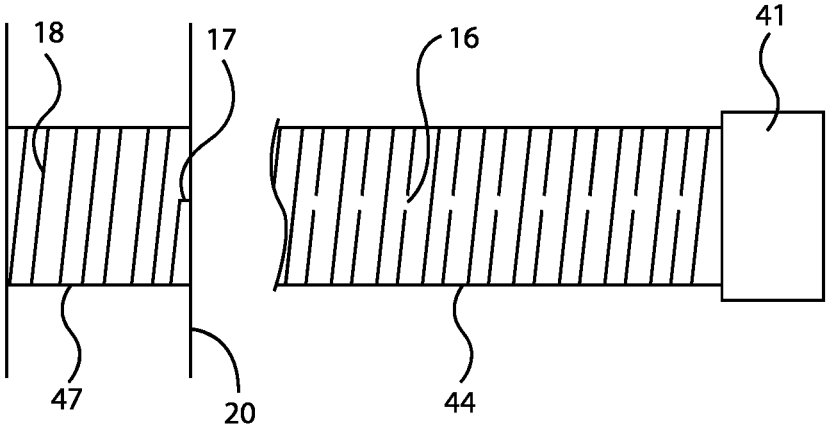
FIG. 43 is a simplified illustration of a turnable actuation member illustrating the interaction between the turnable actuation member and stationary member of the application.

With attention to FIG. 43, in another embodiment of a turnable actuation member 40 a threaded shaft member 44 may include a plurality of gaps 16 or breaks in the threads at one or more desired points along the shaft member 44—each gap 16 representing a different shaving position. In this embodiment, a threaded second aperture 47 may include a projection or catch member 17 extending out from the inner surface or threads 18, the catch member 17 being operationally configured to engage each gap 16 setting the actuation member 40 at a variety of fixed positions during operation of the body shaver 10. In operation, when pressure is applied to the actuation member 40 the shaft member 44 may shift as a gap 16 in the threading is aligned with the catch member 17 resulting in the catch member 17 resting within the gap 16. When a user desires to change the position of the adjustable member 30 the user can move the actuation member 40 in a manner effective to disengage the catch member 17 allowing the actuation member 40 to be turned according to its threaded communication with the second aperture 47. In other words engagement and disengagement of the gaps 16 and catch member 17 may be accomplished via linear pushing/pulling of the actuation member 40. In another embodiment, the gaps 16 may be located along the threading 18 of the second aperture 47 with a catch member being located at a desired point along the shaft member 44.

Blade members 22 of this application may be constructed from one or more materials according to one or more particular body hair shaving usages, e.g., one or more materials of construction may be desired for cutting hair of a short beard compared to a smooth shave. Suitable blade member materials of construction include, but are not necessarily limited to metals, for example, steel, aluminum, titanium, and combinations thereof. In one particular embodiment, blade member 22 materials of construction may include stainless steel with a composition of chromium between about 12.0 to 14.5 percent, and a carbon content of about 0.6 percent. Other chromium and/or carbon contents are herein contemplated as understood by the skilled artisan.

Persons of ordinary skill in the art will appreciate that shaving and/or trimming may have different or preferred blade member 22 characteristics. For example, hair trimming may depend more heavily on the sharpness of the blade members 22 as compared to shaving blade members 22, or vice versa. In addition, shaving purposed blade members 22 may require a coating on the surface to provide a smoother shave against a person's skin, which is not as much of an issue in hair trimming. Because the present body shaver 10 may be used for both shaving and trimming, the blade members 22 employed may possess characteristics to enhance or maximize the results of both shaving and trimming.

In an embodiment incorporating one or more retaining clips 14, the blade members 22 suitably include a design effective to communicate with a stationary member 20 while being sandwiched by one or more retaining clips 14. Without limiting the invention, one suitable shape of blade members 22, including body shavers having a plurality of blade members 22, includes a bent or L-shape configuration that may secured to the stationary member 20 as described in U.S. Pat. No. 7,197,825 entitled "Razors and shaving cartridges with guard," the contents of which is herein incorporated by reference in its entirety. In another embodiment, blade members 22 may be provided to include blade supports as described in U.S. Pat. No. 7,748,121 entitled "Razor blade and support assembly," the contents of which is herein incorporated by reference in its entirety.

Figure 44:
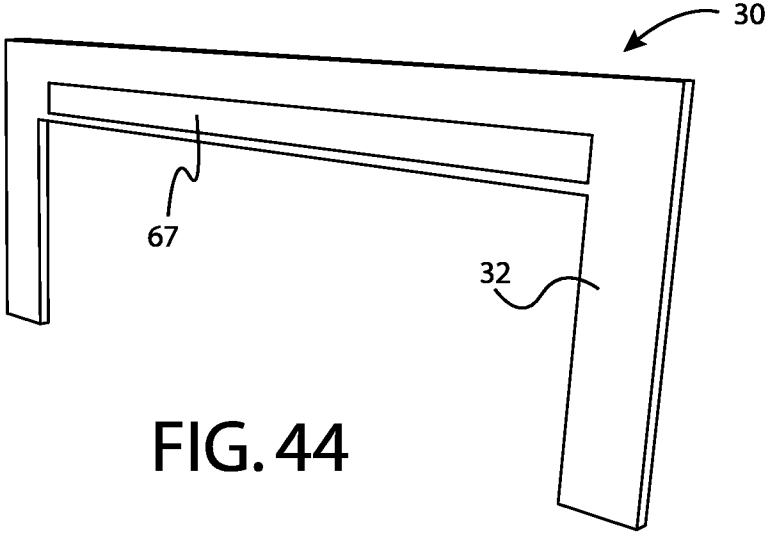
FIG. 44 is a perspective view of an embodiment of an adjustable member including a lubricating member.

The body shaver 10 of this application may also include one or more lubricating members or materials as provided by commercially available wet shavers. In one simplified embodiment as depicted in FIG. 44, a lubricating member may be provided as a lubricating strip 67 disposed along the outer surface 32 of the horizontal section 30A of the adjustable member 30. In another embodiment, one or more lubricating members may be disposed along one or both of the opposing sections 33A and 33B in addition to one or more lubricating members disposed along the horizontal section 30A. In another embodiment, a single lubricating member may be disposed from or near section 33A along section 30A and terminating along or near section 33B. In still another embodiment, one or more lubricating members may be disposed along one or both of the opposing sections 33A and 33B with no lubricating members along section horizontal section 30A. Without limiting the lubricating member to a particular embodiment, suitable lubricating members may be constructed from like materials as lubricating members provided on commercially available wet shavers. One exemplary lubricating member may include a lubricating strip 67 constructed from one or more polymeric materials. For example, a polyurethane lubricating strip 67 impregnated with acrylic polymers may be provided that is operationally configured to absorb water providing a slippery outer surface against a user's skin, which assists with directional movement of the one more blade members 22 during body hair cutting, e.g., helps to prevent snagging or cutting of the skin.

Lubricating members of this application may also include one or more lubricating agents as desired. The lubricating agents may be combined with conventional dermal conditioners, fluids, or similar ingredients useful in wet shaving systems including, for example, lanolins, oils, moisturizers, emollients, and combinations thereof. Additional ingredients, may comprise, for example, (1) skin health-related ingredients such as dermatologic agents (acne, flaky skin, itchy skin), balancing agents (dry or oily skin, pH correct, moisturizers, seasonal solution), rejuvenation/revitalization agents, and combinations thereof (vitamin therapies such as Vitamin E, herbal therapies such as aloe vera, conditioners, acids, cell renewal), cleansing agents (antibacterial, natural, hypoallergenic, botanical-derived, fragrant or fragrance free), or skin-protective agents (Ultra-Violet ("UV"), anti-aging, anti-wrinkle agents); (2) skin sensation agents such as menthol, pain-relief (aspirin), and combinations thereof; (3) soothing agents including neosporin; (4) hair treating agents such as beard softeners, hair growth inhibitors, hair outer layer degradants, hair hydrating agents, hair conditioners, hair thinning agents, and combinations thereof; (5) cosmetics such as tanning agents; (6) aromatherapeutants including perfumes, essences, and combinations thereof; and (7) other agents such as oil, milks, honey, gels, creams, balms, catalysts, effervescents, and combinations thereof.

The invention will be better understood with reference to the following non-limiting example, which is illustrative only and not intended to limit the present invention to a particular embodiment.

Example 1

Figure 72:
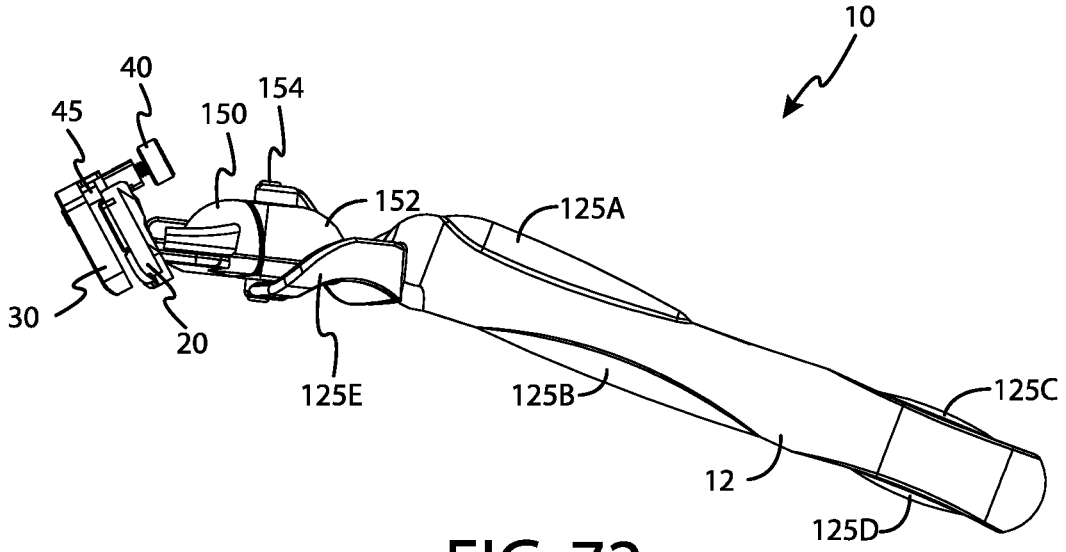
FIG. 72 is a side view of another embodiment of the body shaver including an adjustable razor assembly set at fully extended position.
Figure 73:
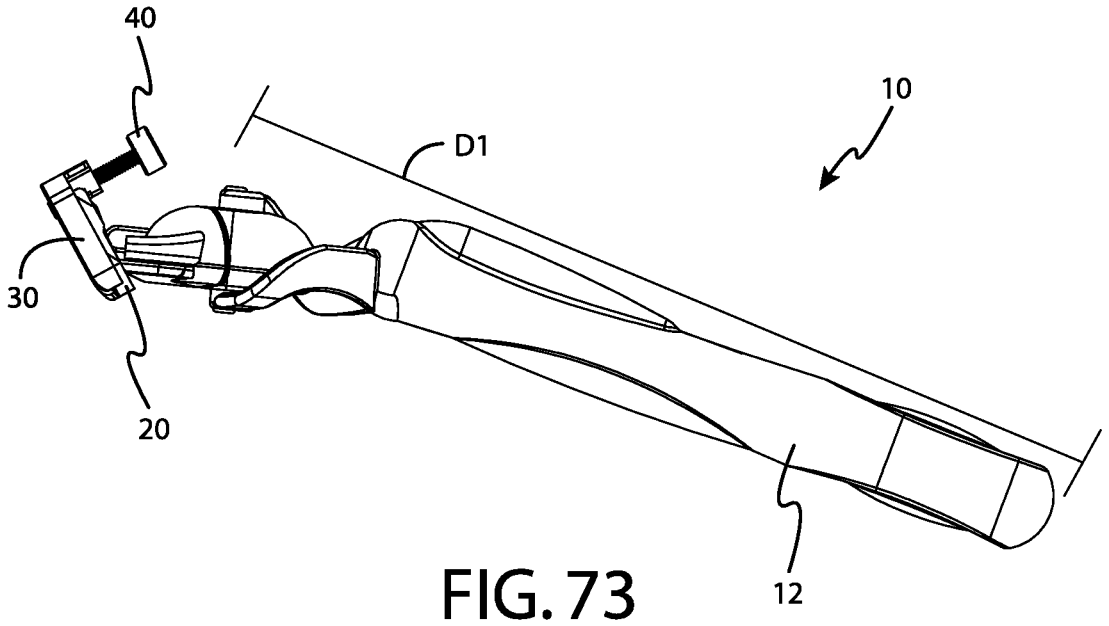
FIG. 73 is a side view of the body shaver of FIG. 72 depicting the adjustable razor assembly set at a fully retracted position.

In a first non-limiting example, another embodiment of the body shaver 10 is provided as shown in the simplified illustrations of FIGS. 72-79. FIG. 72 illustrates a body shaver 10 with an adjustable member 30 set at a fully extended position apart from a stationary member 20. FIG. 73 illustrates the body shaver 10 of FIG. 72 with the adjustable member 30 set at a fully retracted position in abutment with the stationary member 20.

The handle 12 of this embodiment is not limited to any one particular surface configuration, but may include a surface configuration suitable for desired handling of the body shaver 10 during use. As depicted in FIG. 72, the outer surface of a handle 12 may include a stylized surface configuration comprising one or more aesthetic characteristics for marketing purposes or for one or more targeted purchasers. For example, a handle 12 may include one or more enhanced or augmented gripping regions 125A-125E operationally configured to receive particular parts of a user's hand in direct contact against the surface of the gripping regions 125A-125E. Although the body shaver 10 may be built to scale, a suitable body shaver 10 of this application may include a handle 12 having a length D1 ranging from about 8.0 cm to about 12.0 cm (about 3.15 inches to about 4.72 inches).

As shown, the stationary member 20 of this embodiment includes a connecting member 150 that is operationally configured to releasably attach to an adapter end 152 of the handle 12 (or other intermediate attachment member) in a manner similar as described in U.S. Pat. No. 8,793,880 entitled "Shaving razor adapter attaching a shaving razor cartridge to a shaving razor handle," the contents of which is herein incorporated by reference in its entirety. As such, the adapter end 152 further includes an ejector button 154 received through an opening along the adapter end 152 that interfaces with a mechanism used to eject the adjustable razor assembly 13. Such connection features for use herein are also described in U.S. Pat. No. 5,787,586 entitled "Shaving system and method," the contents of which is herein incorporated by reference in its entirety.

Figure 74:
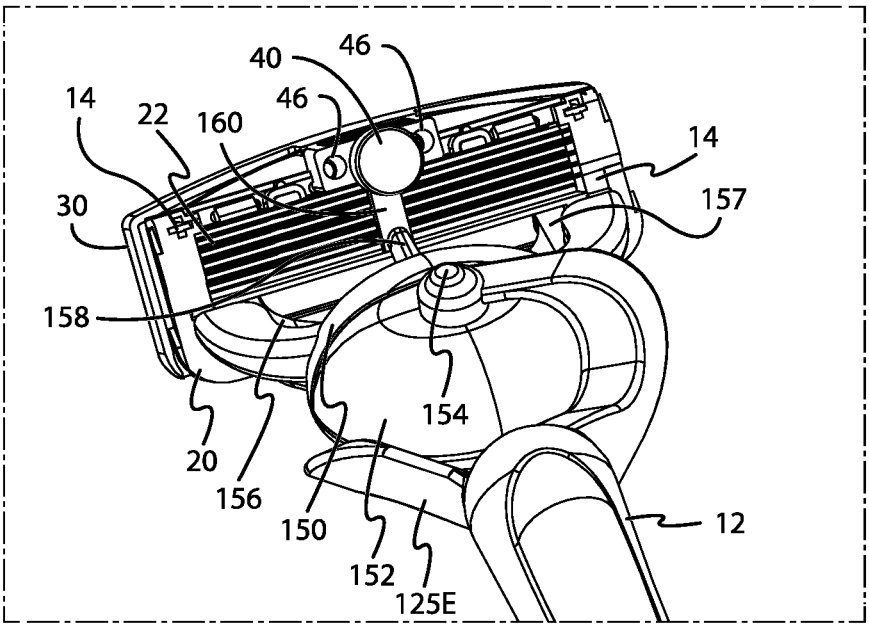
FIG. 74 is a partial perspective view of an adjustable razor assembly and an adapter end of a handle of the body shaver of FIG. 72.

Referring to FIG. 74, the connecting member 150 is attached to the stationary member 20 via arm members 156, 157 and a neck member 158, which is attached to an elongated support divider 160 of the stationary member 20, the support divider 160 being located at a midpoint along the outer surface 26 of the stationary member 20. The blade members 22 are provided as a blade cartridge containing a plurality of parallel blade members 22 housed laterally within the framework of the stationary member 20 perpendicular to a longitudinal axis of the elongated support divider 160. In this embodiment, a second aperture 47 for receiving an actuation member 40 there through is located adjacent the elongated support divider 160 at a midpoint of the stationary member 20 with two first apertures 46 located on opposing sides of the second aperture 47 operationally configured to receive corresponding guide members 45 there through.

Figure 75:
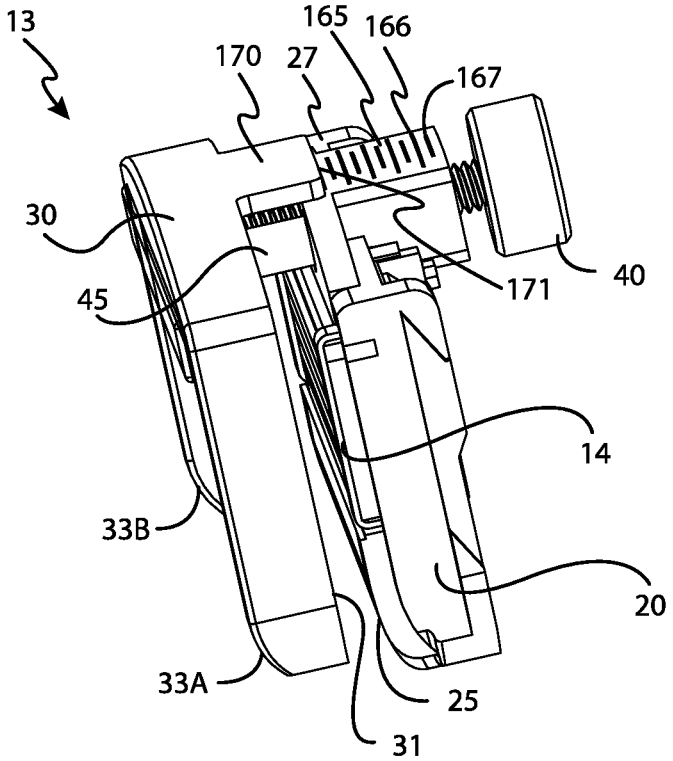
FIG. 75 is a perspective view of an adjustable razor assembly of the body shaver of FIG. 72.

Referring to FIG. 75, the adjustable member 30 of this embodiment may include curved opposing sections 33A, 33B or curved distal ends as shown. In addition, the stationary member 20 may include a scale 165 disposed along part of the third surface 27 for setting the adjustable razor assembly 13 at a desired shaving setting or position for removing a desired length of hair, e.g., the operable distance between the inner surface 31 of the adjustable member 30 and the inner surface 25 of the stationary member 20. In this embodiment, the adjustable member 30 may include a ledge member 170 with a distal surface or face 171, whereby a user may manipulate the actuation member 40 clockwise and/or counter-clockwise to direct the adjustable member 30 linearly whereby a user may align the face 171 of the ledge member 170 with one of a plurality of major alignment marks 166 or minor alignment marks 167 of the scale 165 thereby establishing and/or recording a set position of the adjustable member 30 in relation to the stationary member 20 for use and future reference. As such, in one embodiment a scale 165 may be effective to provide reusable information regarding a desired set position of the adjustable member 30 in relation to the stationary member 20. In another embodiment, one or more calculations may be made to establish (1) the size of major and minor marks 166, 167 and/or the distance between adjacent marks along the third surface 27 and/or (2) the maximum and minimum locations of the face 171 in relation to the usable length of an actuation member 40 to provide particular distance information regarding the distance between the inner surface 31 of the adjustable member 30 and the inner surface 25 of the stationary member 20—using the metric system and/or the imperial system. In one embodiment, the major and minor marks 166, 167 may include raised marks, etchings or cut out grooves, printed marks, and combinations thereof. As shown in this embodiment, the major and minor marks 166, 167 include line marks, but other types of marks are herein contemplated for use with line marks or in place of line marks, e.g., letters, numbers, dots, arrows, diamonds, sidebars, symbols, and combinations thereof.

Figure 76:
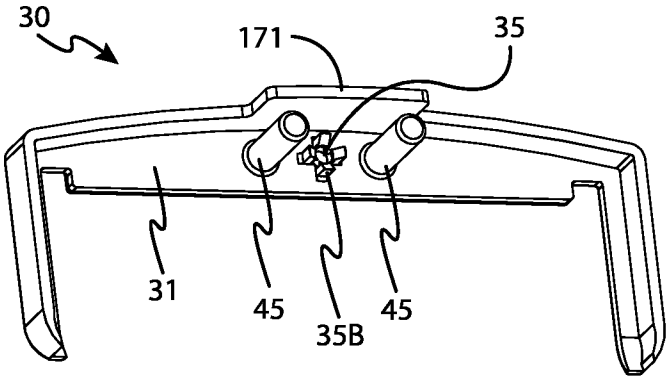
FIG. 76 is a perspective view of an adjustable member of the body shaver of FIG. 72.

Turning to FIG. 76, the adjustable member 30 of this embodiment includes an inner surface 31 having a receiving member 35 located at a midpoint of the adjustable member 30 for receiving a turnable actuation member 40 in operable communication. In particular, the receiving member 35 of this embodiment includes four individual raised members 35B with inner surfaces collectively providing a circular type inner surface for receiving an actuation member 40 in a mated position therein. Suitably, each of the four raised members 35B may be directed radially outward when inserting an actuation member 40 therein and bias radially inward to help hold the actuation member 40 in a mated position. The adjustable member 30 of this embodiment also includes two cylindrical guide members 45 on opposite sides of the receiving member 35, each guide member 45 extending out from the inner surface 31 a distance effective to mate with the two first apertures 46 of the stationary member 20.

Figure 78:
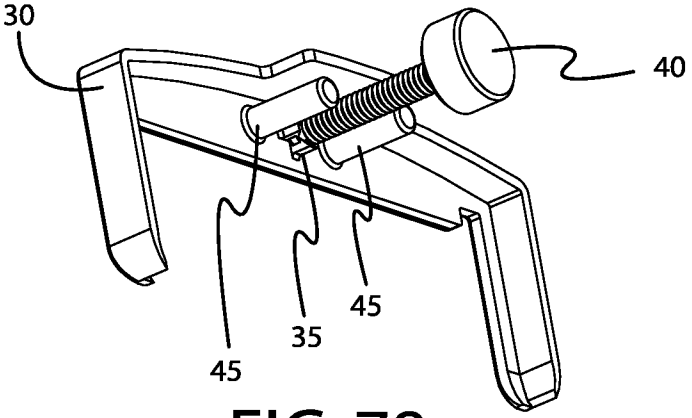
Figure 77:
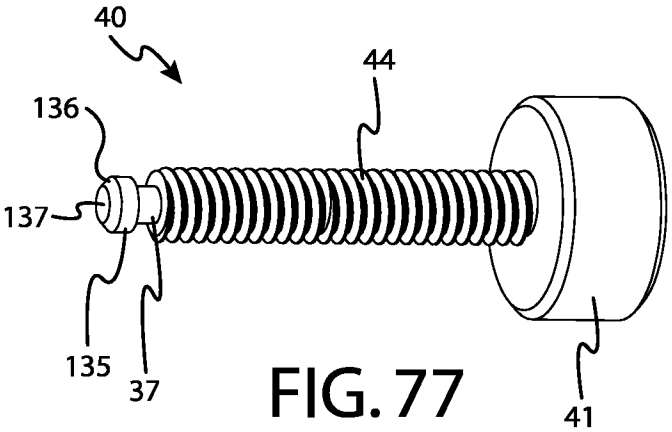
FIG. 77 is a perspective view of an actuation member of the body shaver of FIG. 72.

One suitable turnable actuation member 40 for communicating with the receiving member 35 of this embodiment is depicted in FIG. 77. According to the configuration of the receiving member 35, the actuation member 40 suitably includes a first end 41, an elongated threaded shaft member 44, a neck member 37 and a second end 42 defined by a head member including a cylindrical surface section 135 and a conical surface section 136 terminating in a planar face surface 137, the configuration being effective for mating with the receiving member 35 as shown in FIG. 78. As shown, the cylindrical surface section 135 includes an outer diameter greater than the neck member 37 and the planar face surface 137 includes an outer diameter substantially similar as the outer diameter of the neck member 37 although the shapes and/or diameters/widths of the parts of an actuation member 40 may vary as desired.

Figure 79:
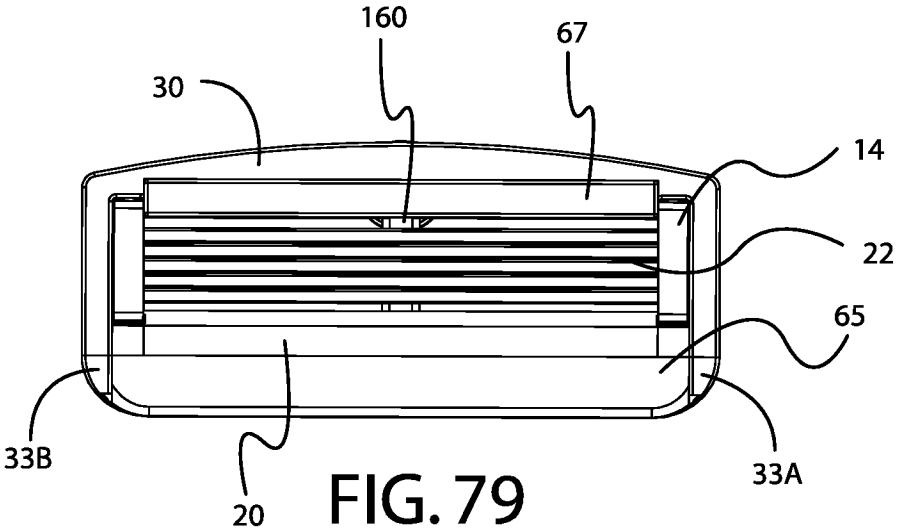
FIG. 79 is a front view of the adjustable razor assembly of the body shaver of FIG. 72.

With attention to FIG. 79, the body shaver 10 of this embodiment may also include a skin guard member 65, a lubricating strip 67 and opposing retaining clips 14 as found on commercially available wet shavers. In one aspect, the body shaver 10 of this embodiment may be set to a shave setting for providing a smooth type clean shave as understood by persons of ordinary skill in the art of wet shavers. In another aspect, the body shaver 10 of this embodiment may be set to a trim setting for cutting target hair to a desired length, for example, a length visible to the naked eye.

Persons of ordinary skill in the art will recognize that many modifications may be made to the present application without departing from the spirit and scope of the application. The embodiment(s) described herein are meant to be illustrative only and should not be taken as limiting the invention, which is defined in the claims. All original claims submitted with this specification are incorporated by reference in their entirety as if fully set forth herein.

We claim:

1. A method of shaving hair located at one or more shaving areas to one or more desired lengths, comprising the following steps:

providing a hand held wet shaver comprising a razor assembly including a cartridge having one or more hair cutting edges and an adjustable guard member in communication with the cartridge via a guide post and a threaded screw type member comprising a length and providing adjustment of the razor assembly according to the one or more desired lengths of hair, wherein the threaded screw type member is in threaded communication with the cartridge and in turnable communication with the adjustable guide member, wherein part of the length of the threaded screw type member comprises a non-threaded end portion and the adjustable guard member includes an inner surface operationally configured to receive and hold the non-threaded end portion in turnable communication, wherein the adjustable guard member is fixed at one of a plurality of distances from the cartridge after turning the threaded screw type member so that the adjustable guide member is moved to one of said plurality of distances from the cartridge according to the turnable communication between the inner surface of the adjustable guard member and the non-threaded end portion of the threaded screw type member;

establishing one or more shaving areas and desired length of hair to remain at the one or more shaving areas following shaving;

adjusting the adjustable guard member to a distance of the plurality of distances from the cartridge by turning the threaded screw type member according to a first established desired length of hair; and shaving the hair located at the one or more shaving areas.

2. A shaving device (10), including:

a handle (12); and a razor assembly (13) located at a front end of the handle (12), the razor assembly including (a) a cartridge (20) with (i) at least one blade (22) and (ii) an aperture (47), wherein the cartridge (20) is attached to the handle, (b)

an adjustable guard member (30) adjustably connected to the cartridge (20), the adjustable guard member (30) having an inner surface (31) comprising a receiving member (35) and (c) a screw type member (40);

wherein the screw type member (40) includes a threaded shaft (44), a first end (41) and a second end (42), the threaded shaft (44) being disposed through the aperture (47);

wherein the receiving member (35) includes an inner surface operationally configured to receive and hold the second end (42) of the screw type member (40) in a mated position therein in a manner effective for the second end (42) to act on the inner surface of the receiving member (35) to direct the adjustable guard member (30) away from the cartridge (20) when the screw type member (40) is turned in a first direction and direct the adjustable guard member (30) toward the cartridge (20) when the screw type member (40) is turned in a second opposite direction;

wherein turning of the screw type member (40) in the first direction and the second opposite direction promotes travel of the screw type member (40) through the aperture (47) of the cartridge (20) in a manner effective to adjust the distance between the adjustable guard member (30) and the cartridge (20) at a plurality of fixed distance settings, each fixed distance setting dictating the length of hair to be cut from one or more shaving areas of an individual; and wherein the adjustable guard member (30) has an outer surface (32) for contacting the one or more shaving areas of an individual and the inner surface (31) includes a guide member (45) that is slidably disposed through a second aperture (46) in the cartridge (20).

3. The shaving device (10) of claim 2 wherein the razor assembly (13) is removable from the handle (12).

4. The shaving device (10) of claim 2 wherein the guide member (45) operates to maintain alignment between the adjustable guard member (30) and the cartridge (20).

5. The shaving device (10) of claim 4 wherein the second end (42) of the screw type member (4) is in turnable communication with the inner surface of the receiving member (35) and the threaded shaft (44) is in operable communication with the aperture (47) of the cartridge (20).

6. The shaving device (10) of claim 5 wherein the adjustable guard member (30) includes a three sectional framework including an upper horizontal section disposed between two opposing vertical sections (33A), (33B) with curved distal ends.

7. The shaving device (10) of claim 5 wherein the guide member (45) is fixed to the inner surface (31) of the adjustable guard member (31) and extends out from the inner surface (31) of the adjustable guard member (31).

8. The shaving device (10) of claim 2 wherein the razor assembly (13) includes a scale to indicate that the razor assembly (13) has the adjustable guide member (30) at a particular fixed distance setting relative to the cartridge (20).

9. The shaving device (10) of claim 2 wherein the threaded shaft (44) comprises a first outer diameter of the screw type member (40) and the second end (42) comprises a second outer diameter of the screw type member (40) different than the first outer diameter of the screw type member (40).

10. A hand held wet shaver comprising a handle and a razor assembly including a cartridge having one or more hair cutting edges and an adjustable guard member in communication with the cartridge via a threaded screw type member and a guide post extending out from the adjustable guard member in a fixed position, wherein the threaded screw type member is in threaded communication with the cartridge and in turnable communication with the adjustable guide member, wherein the adjustable guard member is fixed at one of a plurality of distances from the cartridge after turning the threaded screw type member so that the adjustable guard member is moved to one of said plurality of distances from the cartridge, wherein the adjustable guard member includes a receiving member comprising an inner surface and the threaded screw type member comprises a non-threaded mating end portion, wherein the inner surface of the receiving member is operationally configured to receive and hold the non-threaded mating end portion in a manner effective for the non-threaded mating end portion to direct the adjustable guard member away from the cartridge when the threaded screw type member is turned in a first direction and direct the adjustable guard member toward the cartridge when the screw type member is turned in a second opposite direction.

11. The hand held wet shaver of claim 10 wherein the plurality of distances of the adjustable guard member includes an abutment position with the cartridge and one or more distances apart from the cartridge.

12. The hand held wet shaver of claim 11 wherein the guide post is a non-turnable elongated member with a segmented configuration in communication with the cartridge.

13. The hand held wet shaver of claim 10 wherein the adjustable guard member has an outer surface for contacting one or more shaving areas of an individual, and wherein the threaded screw type member includes a threaded portion comprising a first outer diameter and a free end portion comprising a second outer diameter, wherein the non-threaded mating end portion comprises a third outer diameter different than the first outer diameter and second outer diameter of the threaded screw type member.

* * * * *